US006336718B1

(12) United States Patent
Blanchard, Jr. et al.

(10) Patent No.: US 6,336,718 B1
(45) Date of Patent: Jan. 8, 2002

(54) INK JET PRINTER AND METHOD

(75) Inventors: Raymond A. Blanchard, Jr., Dryden; Charles M. Curley, Ithaca; David M. Stewart, Elmira, all of NY (US)

(73) Assignee: Paxar Corporation, White Plains, NY (US)

( * ) Notice: Subject to any disclaimer, the term of this patent is extended or adjusted under 35 U.S.C. 154(b) by 0 days.

(21) Appl. No.: 09/391,723

(22) Filed: Sep. 8, 1999

Related U.S. Application Data

(63) Continuation-in-part of application No. 08/932,483, filed on Sep. 18, 1997, now Pat. No. 6,142,622.

(51) Int. Cl.[7] ..... B41J 2/17
(52) U.S. Cl. ..... 347/84
(58) Field of Search ..... 347/84, 85, 86, 347/87, 104, 49

(56) References Cited

U.S. PATENT DOCUMENTS 5,666,146 A * 9/1997 Mocizuki et al. ..... 347/86

FOREIGN PATENT DOCUMENTS

| | | |
|---|---|---|
| EP | 0299514 | of 1989 |
| EP | 0311980 | of 1989 |
| EP | 0492871 | of 1992 |
| EP | 0564288 | of 1993 |
| EP | 0700788 | of 1996 |
| JP | 4-001056 | * 1/1992 |

OTHER PUBLICATIONS

Paxar 7500 Operation/Maintenance and Parts List Ed 4.1, Jan. 1995, pp. 1–59.
Paxar 8500 Operation/ Maintenance and Parts List Ed 2.4 Dec. 1996, pp. 1–38.

* cited by examiner

*Primary Examiner*—N. Le
*Assistant Examiner*—Michael P. Nghiem
(74) *Attorney, Agent, or Firm*—Joseph J. Grass

(57) ABSTRACT

There is disclosed an ink jet printer for printing on both sides of a label web. The printer has selectively movable guides which enable the label web to be easily threaded through the printer and which enable the label web to be brought into an operating position for printing and advancing the label web. The printer has individually and selectively removably mounted ink jet print modules to facilitate changing of ink colors, replacing or servicing a malfunctioning print module, and so forth. The ink jet print heads of the modules can be individually selectively moved between printing and stored positions. The unwinding of the label web from the supply roll is facilitated by an unwind mechanism to prevent stretching of the label web. The system for delivering ink and recovering waste ink includes needles for penetrating a cartridge. A guard shields the needles when the module(s) are out of the printer.

9 Claims, 20 Drawing Sheets

49
42
45
47
37
152
151
150
148
145
146
235
46
142
234
140
191
29
141
143
48
43
41

INK JET PRINTER AND METHOD

CROSS-REFERENCE TO RELATED APPLICATION

This is a continuation-in-part of patent application Ser. No. 08/932,483, now U.S. Pat. No. 6,142,622 filed Sep. 18, 1997.

BACKGROUND OF THE INVENTION

1. Field of the Invention

The invention relates to the printing art.

2. Brief Description of the Prior Art

The following prior art is made of record: PAXAR 7500 Operation/Maintenance and Parts List January 1995 and PAXAR 8500 Operation/Maintenance and Parts List November 1996.

SUMMARY OF THE INVENTION

The invention relates to an improved printer for printing on webs of labels.

It is a feature of the invention to provide an improved arrangement to facilitate threading a label web through a printer. The label web is loosely threaded along a path with guides in a loading position and thereafter the guides are repositioned to bring the label web to its operating position. In accordance with a specific embodiment of the invention, the label web passes from a roll and partially about first and second guides. Thereafter, the first and second guides are repositioned to bring the label web to an operating position. There is also a third guide and a back-up roll which are selectively operable between loading positions and operative positions. In the loading position the label web is passed partially around the third guide and a driven feed roll and in the operating position the label web passes partially around the guide and is in the nip between the feed roll and the back-up roll and is wrapped partially about the feed roll.

It is another feature of the invention to provide an improved ink jet printer which can print selectively either on one side or face of the label web or on both sides or faces of the label web in a single pass through the printer. According to the one specific embodiment, the label web can be threaded through the printer along either a first path for printing on one side of the label web or along a second path for printing on both sides of the web. The printer preferably has two print heads which are selectively movable between printing and non-printing positions with respect to the label web.

It is another feature of the invention to provide an ink jet printer for printing on both sides of a label web wherein one or more print modules are selectively removable from the printer. Each print module preferably includes all the structure for printing on the label web in response to data received. It is a simple matter to replace a print module having ink of one color with a like print module having ink of a different color. The removability of a print module also facilitates replacement of a malfunctioning print module, or removal of an unneeded print module while the remaining module is operational, or the servicing of the printer or its print modules.

It is also a feature of the invention to provide an ink jet printer for printing on both sides of a label web wherein one or more ink jet print heads are individually selectively positionable either in printing positions or in non-printing positions. A non-printing position is useful for example when threading the label web through the printer to prevent ink from the ink jet print head or heads from contacting the label web. The print heads can be moved to a non-operating or stored position whenever a the print head is not used. A wiper can wipe the print head clean of ink as the print head is being moved to its stored position and in the stored position a seal which seals off the orifices of the print head.

It is another feature of the invention to provide an improved printer having an ink jet print head connected to a source of ink by a pointed needle, wherein there is a guard for guarding off the pointed end of the needle. More particularly, the print head and the needle are part of a print head module which is removable from the printer, and the guard is effective until the print head module has been inserted into the printer. Upon insertion of the module into the printer the guard is deactivated.

It is another feature of the invention to provide an improved printer for printing on both sides of a label web, wherein an unwind mechanism helps to unwind a label web from a supply roll, to avoid excessive stretching of the label web wherein the label web can be threaded through the printer along one path in the event the label web is to be printed on both sides and along another path in the event the label web is to be printed on only one side, and wherein the label web is drawn through the printer by an advancing mechanism over either one of the paths.

DETAILED DESCRIPTION OF THE PREFERRED EMBODIMENT

Figure 1:
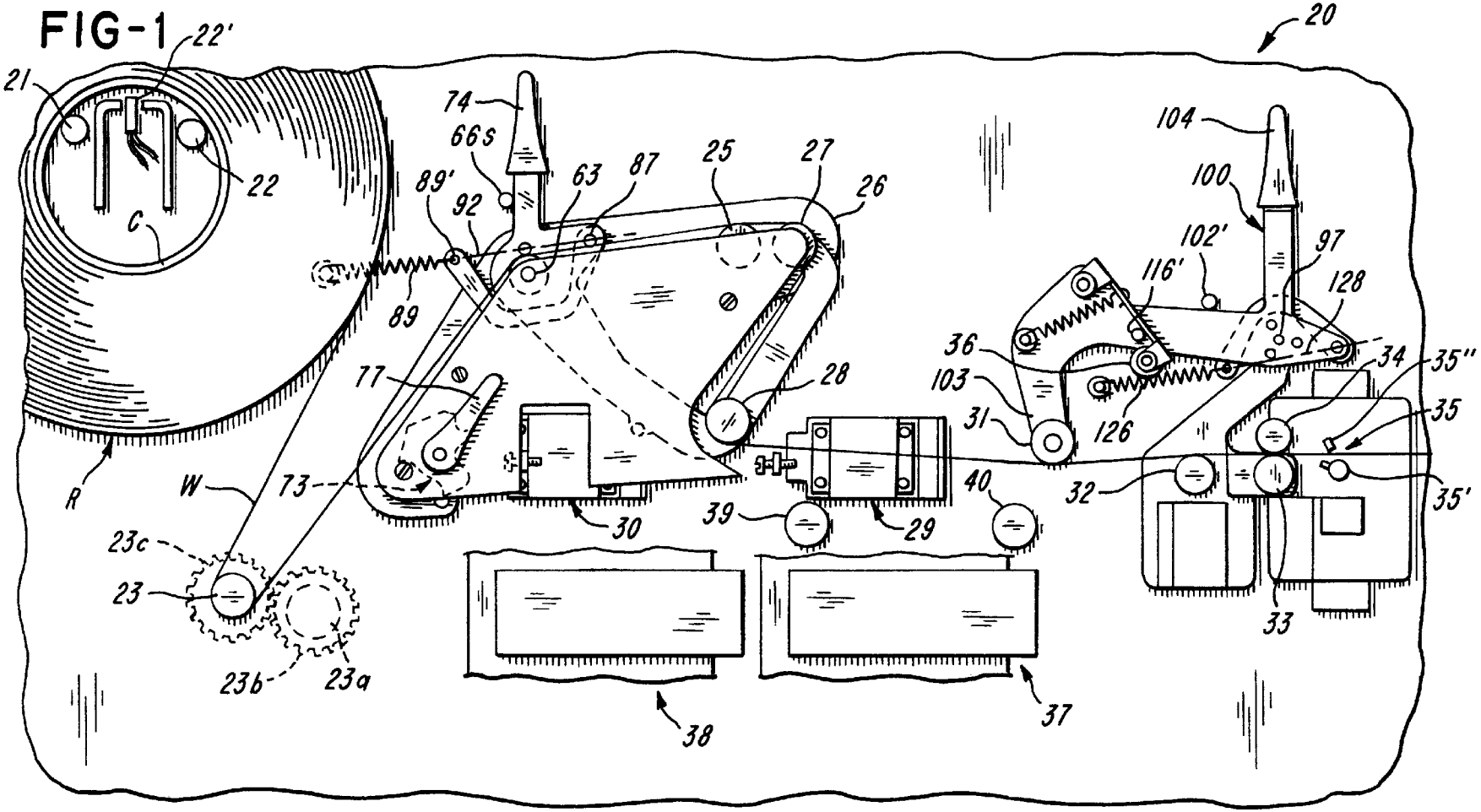
FIG. 1 is a fragmentary front elevational view of the printer of the invention in its label web loading position.

With reference to FIG. 1, there is shown an ink jet printer generally indicated at 20 for printing on a web W of labels. The web W can be comprised of fabric such as is used in the garment industry, or the web can be comprised of paper, plastics or other printable materials. A supply roll R of the web W is shown to be rotatably supported on a pair of parallel rollers 21 and 22. There is a sensor 22' for reading a bar code on the core C of the roll R. The sensor 22' is part of a system for controlling a hysteresis brake 23*a* which is coupled to the roll or spindle 23 by meshing gears 23*b* and 23*c*. The web W is paid out of the roll R as it passes downwardly and partially about a direction-changing guide in the form of a rotatable roller 23, and from there the web W passes upwardly and over and partially around a guide 24 preferably in the form of a crowned roller which is rotatably supported on a frame plate 26. The web W passes from the guide 24 over and in contact with the guide 25 and over and partially about a guide 27 preferably in the form of a roller. From there the web W passes downwardly and partially around and under a guide 28 preferably in the form of a roller. From there the web W passes in front of the right-hand print head generally indicated at 29 and above guides 39 and 40. In this position the print head 29 as well as a print head or print head pair 30 are in their respective stored position. The web W passes under a guide in the form of a roller 31 and over a feed roll 32. From there the web W passes between an auxiliary feed roll 33 and a back-up roll 34. From there the web W passes to a knife 35 having a rotary blade 35' and a fixed blade 35" by which the web W can be severed into labels. The foregoing describes the manner in which the web W is loaded or threaded into the printer 20. The guides 27, 28 and 31 and a back-up roll 36 are shown in FIG. 1 to be in the loading position. It is seen that the path along which the web is loaded or threaded in essentially unobstructed in the loading position.

Figure 2:
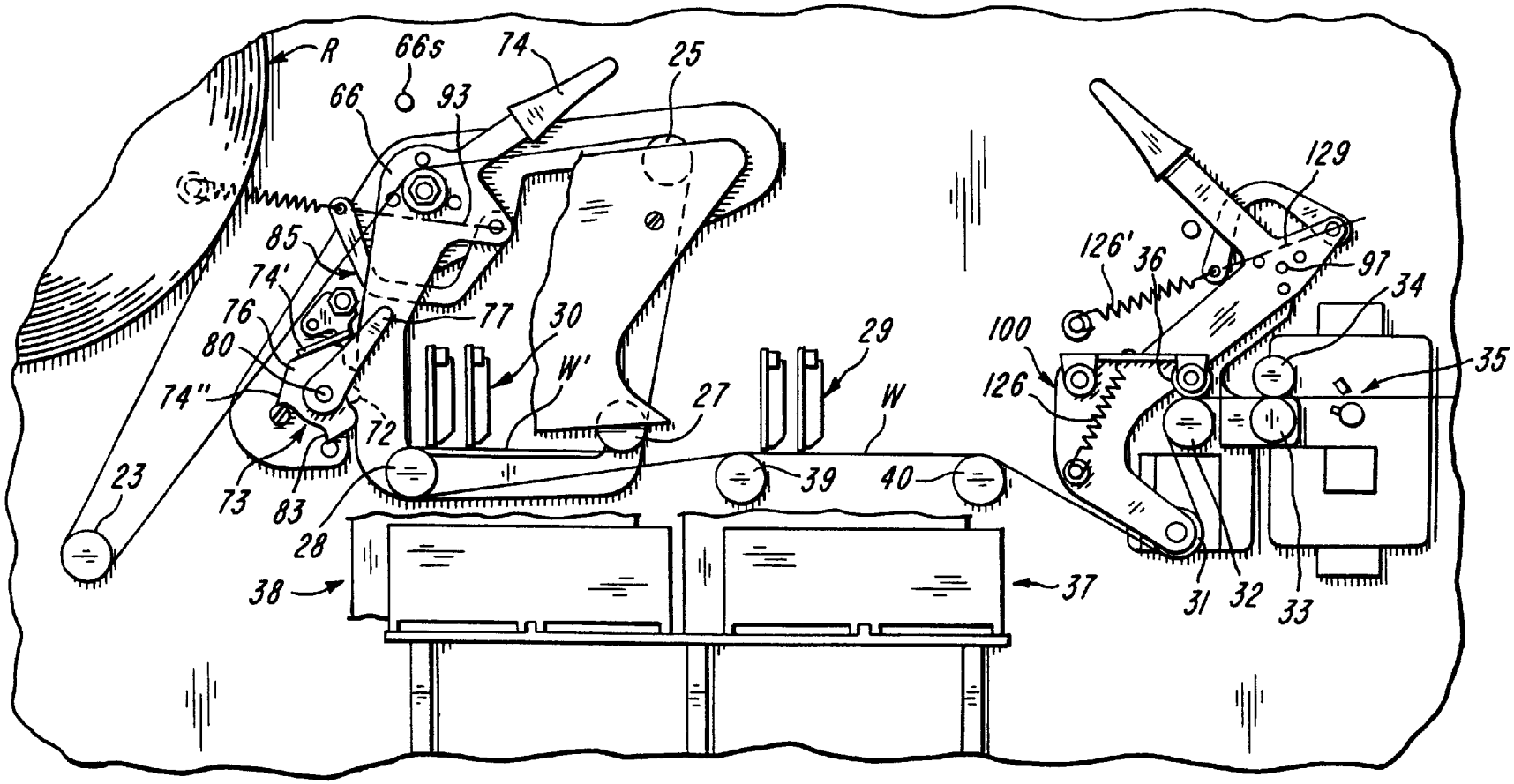
FIG. 2 is a view similar to FIG. 1, but showing the printer operating in a two-sided one mode in its printing or operating position.

The print heads 29 and 30 are part of respective identical print modules 37 and 38. The guides 39 and 40, in the form of rollers, support the web W at the proper height with respect to the print heads 29 and 30 (FIG. 2). FIG. 2 shows the web W guided along a path in the printing position according to the mode in which the web W was loaded in the position shown in FIG. 1. However, it is to be noted that the guides 27 and 28 have moved to the operating or printing position. It is seen that in FIG. 2, the web W passes partially around the guide 25, and downwardly and partially around and under the guide 27 and over and partially around the guide 28. As the web W passes between the guide 27 and 28 the underside of the web W is printed by the print head 30. From there the web W passes over and in contact with the guides 39 and 40. The print head 29 can now print on the upper or top side of the web W. After the web W passes over and partially around the roll or guide 40, the web W is trained partially about the roll 31 and is wrapped partially about the feed roll 32. The feed roll 32 has a frictional outer surface formed of a metallic grit surface. The feed roll 32 which cooperates with the backup roll 36, has contact with the web W over a substantial portion of the periphery of the roll 32. It is seen that in this mode both sides of the web W can be printed upon.

Figure 3:
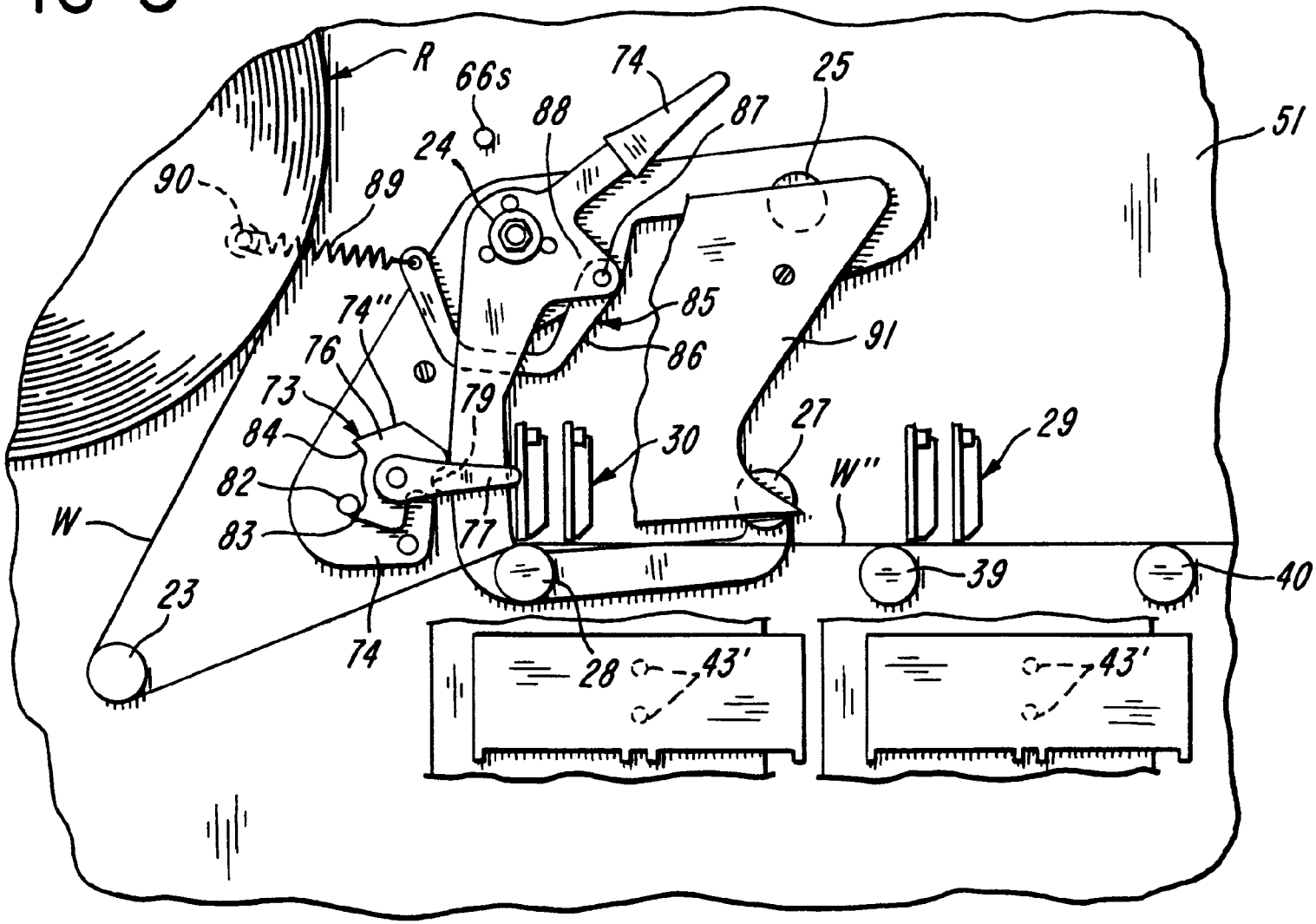
FIG. 3 is a side elevational view showing a portion of the printer, but operating in a one-sided mode.

FIG. 3 illustrates how the web is threaded in a different mode in which only one side of the web W is to be printed. The web W is paid out from the roll R and passes partly around the guide 28 and over the guides 39 and 40. It is seen that the guide 27 is slightly elevated from the position shown in FIG. 2 so that the upper side of the web W does not touch the guide 27. This obviates the possibility that ink which has just been printed on the web W by the print head 30 might be smeared by the guide 27. As the web W passes to the right (FIG. 3) the print head 29 can print on the upper side of the web 29.

Figure 4:
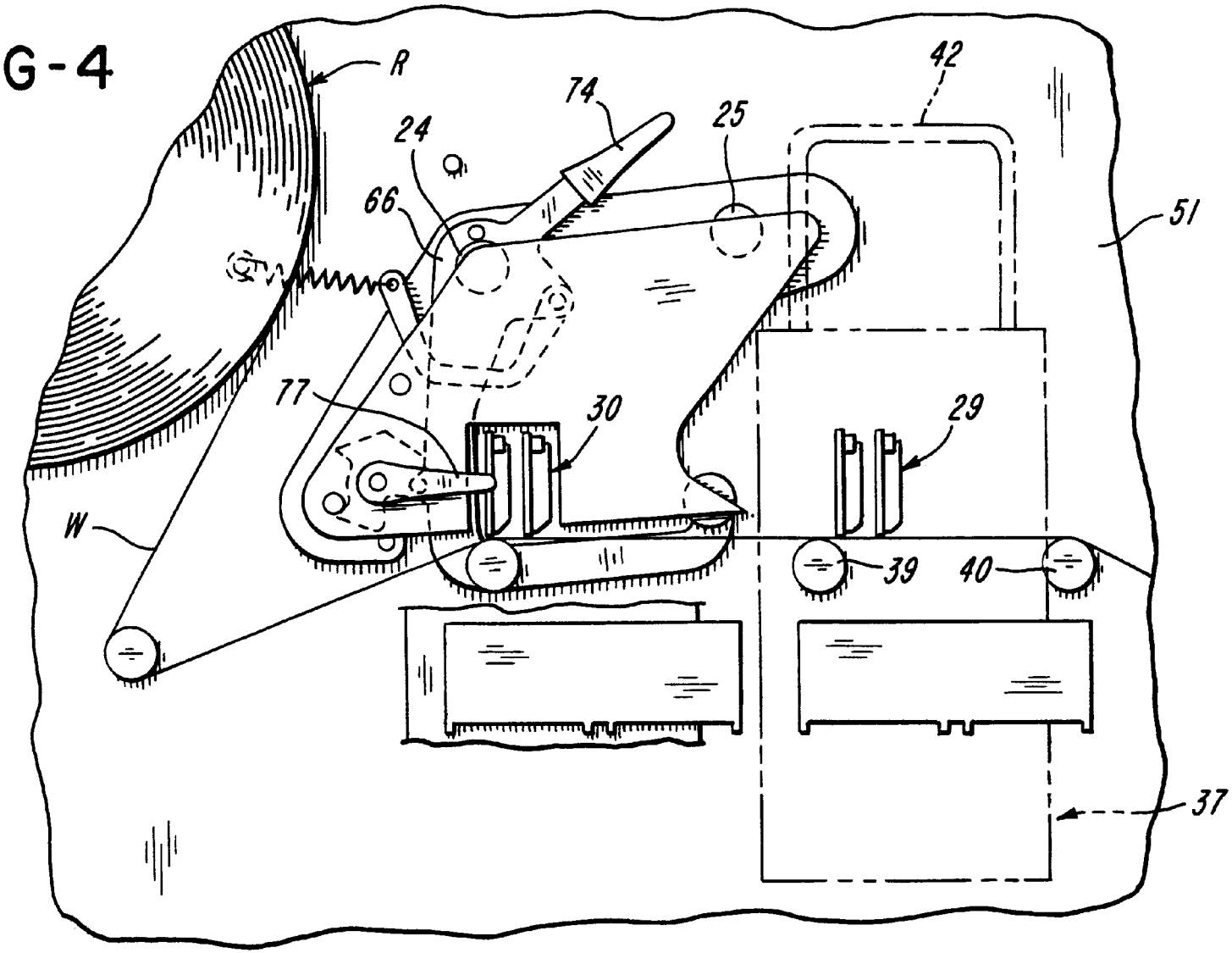
FIG. 4 is a view similar to FIG. 3, but showing one of the print modules partially in phantom lines and partially in solid lines.

With reference to FIG. 4 the location of the print modules 37 and 38 are shown in greater detail. Except for the print heads 29 and 30 the components of the respective print modules 37 and 38 are designated by the same reference characters. The print modules 37 and 38 are identical except for the color of the ink which they respectively contain. Each print module 37 and 38 has a housing 41 with a handle 42 (FIG. 5) at its upper end. An ink cartridge 43 plugs into a pair of needles 43' in the housing 41. The print modules 37 and 38 include the print heads 29 and 30, which are mounted for pivotal movement between printing and stored positions.

Figure 5:
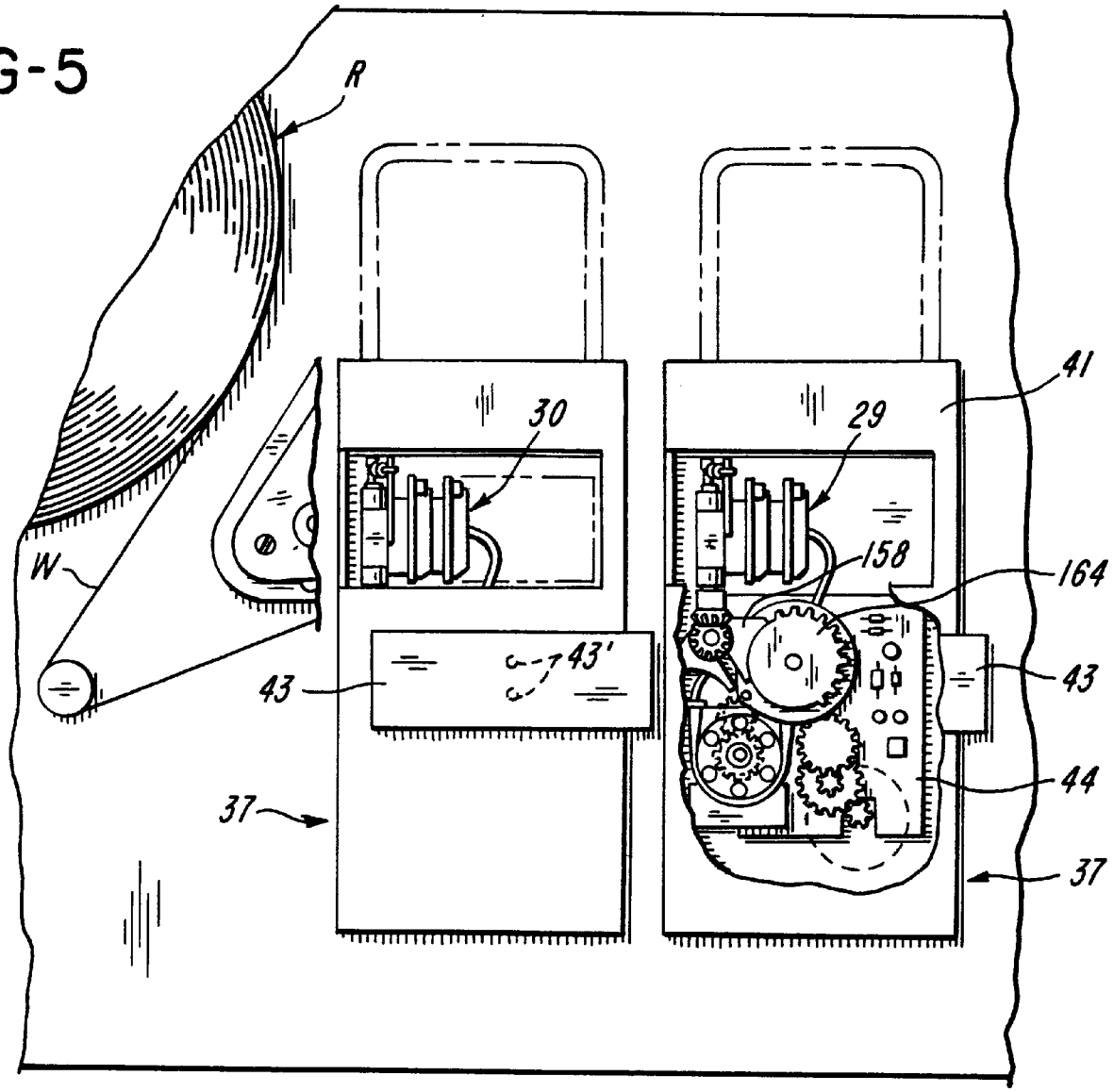
FIG. 5 is a fragmentary front elevational view of the printer with additional structural details of the print modules.
Figure 6:
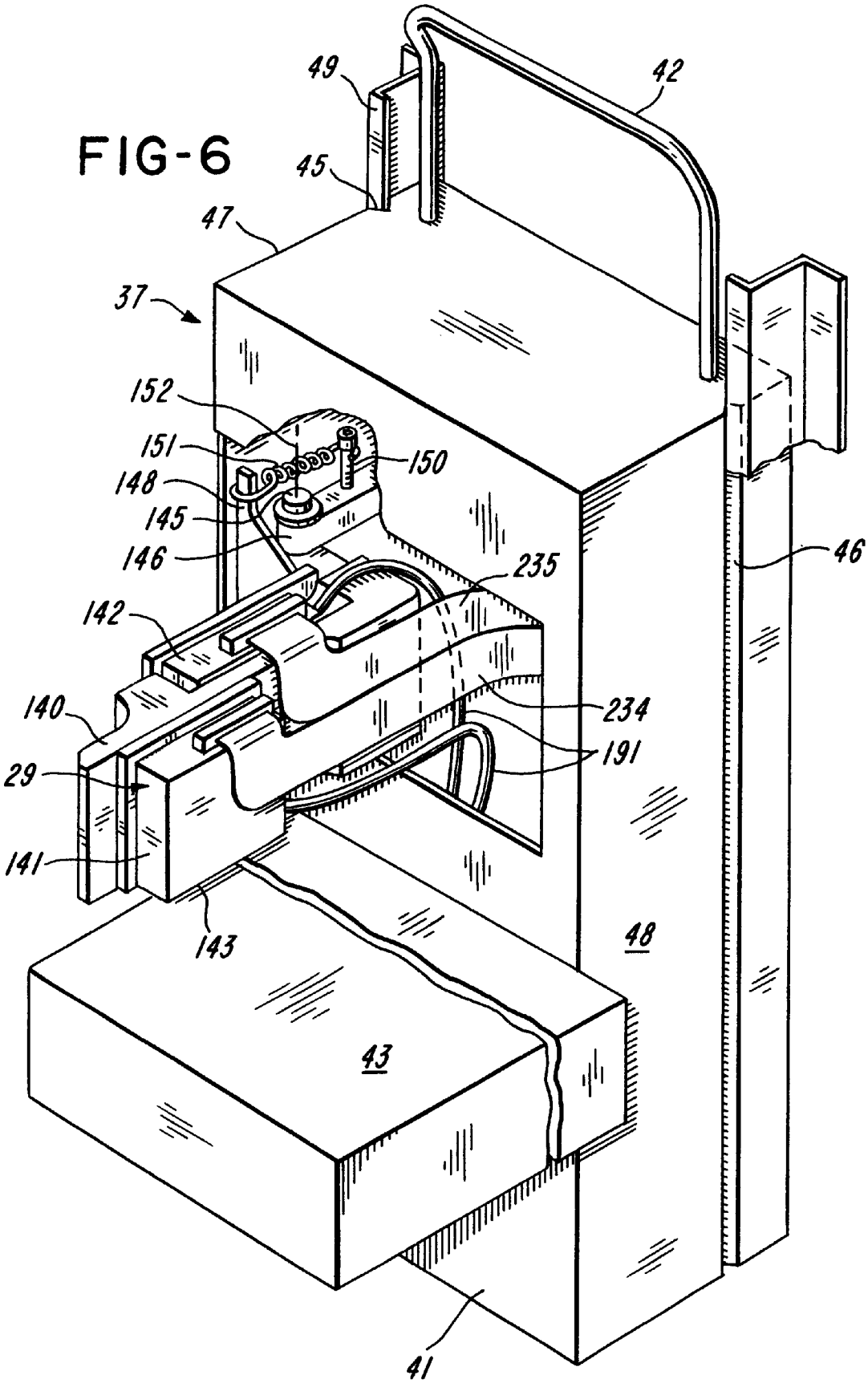
FIG. 6 is a perspective view of one of the print modules.

FIG. 5 shows one of the print modules in greater detail than in FIG. 4. FIG. 6 shows one of the print modules, namely the module 37 with its print head 29 in the printing position. As shown, the housing 41 has parallel V-shaped vertically extending grooves 45 and 46 in opposite sides 47 and 48. A rigid elongate jaw 49 extending the length of the groove 45 is received in the groove 45. A spring-biased jaw 50 extending the length of the groove 46 is received in the groove 46.

Figure 7:
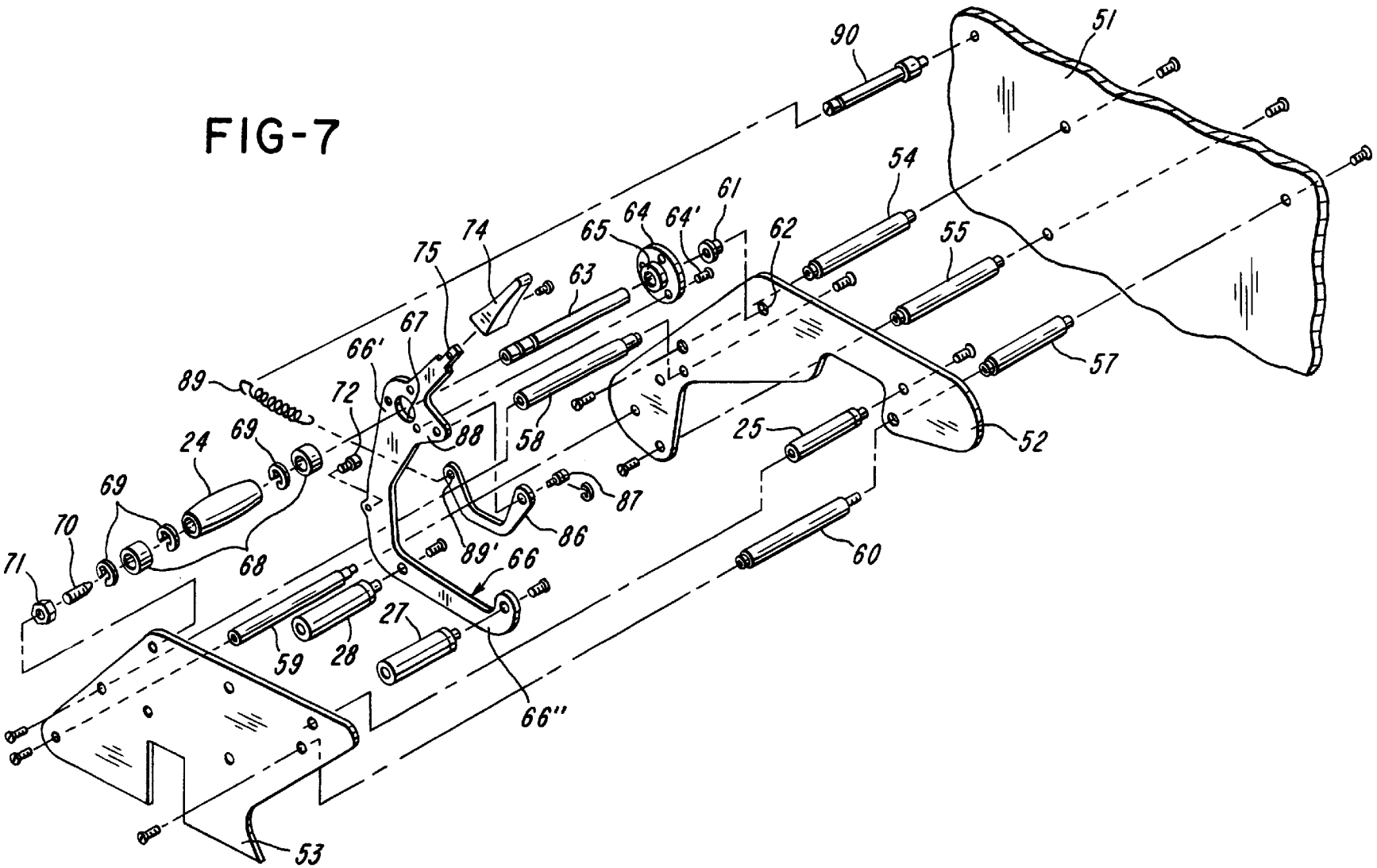
FIG. 7 is an exploded perspective view of supply-side guide structure for the label web.

With reference to FIG. 7, there is shown a vertically extending frame plate 51 and plates 52 and 53. The plates 51, 52 and 53 are parallel to each other. The plate 52 is rigidly secured to the plate 51 by standoffs or spacers 54 and 55 and to the plate 51 and a plate 56 by a standoff or spacer 57. The plate 53 is rigidly secured to the plate 52 by standoffs or spacers 58, 59 and 60. The guide 25 is rotatably mounted to both plates 52 and 53.

A bearing 61 is received in a hole 62 in the plate 52. A shaft 63 is rotatably received in the bearing 61. A plate 64 with an axial collar 65 is secured to an L-shaped actuating member generally indicated at 66. The collar 65 is received in a hole 67 in the member 66. The shaft 63 passes through the plate 64 and its collar 65, and receives a needle bearing 68, C-rings 69, and a cone screw 70. A nut 71 bears against the front of the plate 53 (FIG. 7) and is threadably received by the cone screw 70.

The plate 64 is secured to the plate 66 by three screws 64', only one of which is shown. As shown, the guide 24 is crowned to help keep the web W centered. A cam follower stud 72 is secured to a vertical leg 66' of the member 66 and cooperates with an adjustable stop generally indicated at 73 in FIGS. 2 AND 3. The guides 27 and 28 are rotatably secured to a horizontally extending leg 66" of the member 66. A handle 74 is secured to a tang or handle member 75 of the member 66.

The stop 73 is movable between two positions as indicated respectively in FIG. 2 (which illustrates the two-side printing mode) and in FIG. 3 (which illustrate the one-side printing mode). The stop 73 includes a stop plate 76, a handle 77 secured to the stop plate 76 and a cantilevered leaf spring 78 (shown in FIG. 2 only). FIG. 2 shows the stop plate 76 and the handle 77 oriented in the position corresponding to the two-side mode in which the follower 72 is received in a recess 79 close to axis 80, and the handle 77 is shown to extend in an upward direction at an angle with respect to the vertical. Thus, the member 66 is in its most clockwise position as seen in FIG. 2. This establishes a horizontal pass W' of the web W immediately below the print head 30. The spring 78 releasably holds the stop plate 74 in the FIG. 2 position when its flat lower surface bears against flat surface 74' on the stop plate 74 and in the FIG. 3 position when its flat lower surface bears against flat surface 74" on the stop plate 74.

When the handle 77 is moved to the generally horizontal position shown in FIG. 3, the follower 72 is in a recess 81 further from the axis 80 than the recess 79. Thus, the member 66 is slightly counterclockwise from the position shown in FIG. 2. Accordingly, the guide 27 is in a position spaced above horizontal pass W" of the web between guides 28 and 39. This obviates the possibility of the guide 27 contacting the freshly printed pass W" of the web W which could cause smearing of ink that had not dried sufficiently.

The stop 73 is also shown to include a fixed stop pin 82 which limits the travel of the stop plate 76. The stop pin 82 cooperates with either a stop face 83 (FIG. 3) or with a stop face 84 (FIG. 2). The spring 78 releasably holds the stop plate 76 in either of these positions.

An overcenter mechanism generally indicated at 85 releasably holds the member 66 either in the position shown in FIG. 1 or in the position shown in FIG. 2 in response to movement of the handle 74 to either of these positions. The overcenter mechanism 85 includes a generally U-shaped link 86 pivoted at one end to a pivot 87 on an arm 88 of the member 66. The other end of the link 86 is connected at 89' to a tension spring 89 to a tension spring 89 which is connected to a post 90 on the plate 51. In the FIG. 1 position, the spring 89 exerts a force on the pivot 87 along a line 92 which is above the axis of the shaft 63. Thus, the member 66 is biased counterclockwise against a stop 66*s*. When the handle 74 is moved to the FIG. 2 position, the spring 89 exerts a force along a line 93 which is below the axis of the shaft 63, and thus the member 66 is biased clockwise as limited by the stop 73.

Figure 8:
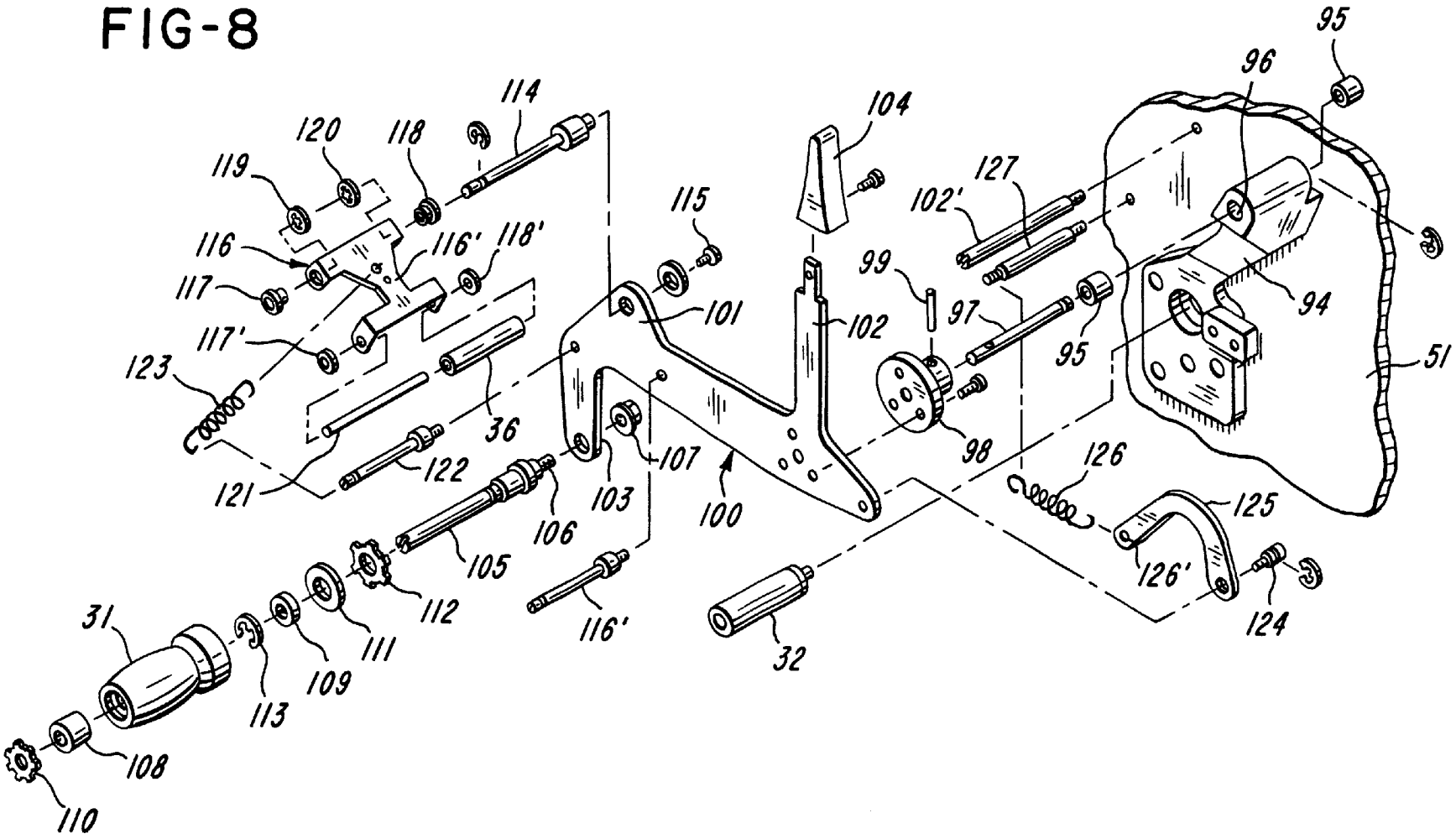
FIG. 8 is an exploded perspective view of feed guide structure for the label web.

With reference to FIG. 8, there is shown a bracket 94 secured to the plate 51. Bearings 95 located in a bore 96 in the bracket 94 rotatably mount a shaft 97. A plate 98 secured to the shaft 97 by a pin 99 is secured to an actuating member generally indicated at 100. The member 100 has an elongate portion 101 with a tab 102 and a tang 102 extending in one direction and an arm 103 extending in the opposite direction. A handle 104 is secured to the tang 102. The arm 103 mounts the guide 31 which is shown to be crowned to help keep the web W centered in its intended path. The arm 103 mounts a shaft 105 having a threaded end portion 106 which receives a nut 107. The shaft 105 receives bearings 108 and 109, washers 110, 111 and 112 and a C-ring 113.

A pivot 114 is secured to the tab 101 by a screw 115. An H-shaped mounting member generally indicated at 116 mounts bearings 117 and 117' and 118 and 118'. Retaining rings 119 and 120 fixedly mount bearings 117 and 118 to the member 116. The pivot 114 passes through the bearings and an E-ring retains the mounting member 116 in place. A pin 121 received by the member 116 rotatably mounts the back-up roll 36. A horizontal portion 116' of the H-shaped member 116 is relatively narrow and can twist to conform to the feed roll 32. The portion 116' is relatively flexible in the torsional direction and functions like a torsional spring.

The member 100 also mounts a post 122. A tension spring 123 is connected at one end to the post 122 and at its other end to the member 116 to bias the member 116 clockwise (FIGS. 1 and 2). There is a stop 102' for the member 100. There is also a stop 116' for the member 116.

A pivot pin 124 secured to the elongate portion 101 pivotally mounts a generally U-shaped link 125. A tension spring 126 is connected to the link 125 at 126' and to a post 127 secured to the frame plate 51. In the position shown in FIG. 1, the spring 126 exerts a force along line 128 below the axis of the shaft 93 to urge the actuator member 100 clockwise, thereby urging the guide 31 and the back-up roll in the loading or threading position. When the handle 104 is moved to the position shown in FIG. 2, the spring 126 exerts a biasing force along a line 129 which is above the axis of the shaft 97 to urge the member 100 into the position shown. It is apparent that as the member 100 is brought into the FIG. 2 position, the spring 126 stretches and the back-up roll 136 for the driven feed roll 32 urges the web W against the feed roll 32. Because the guide 31 is now in the operating position, the web W is trained about a path which in turn causes the web W to be wrapped about a substantial portion of the periphery of the feed roll 32. This contributes to excellent gripping of the web W by the feed roll 32. The feed roll 32 is driven by an electric motor (not shown) disposed behind the plate 51 as seen in FIG. 8.

Figure 9:
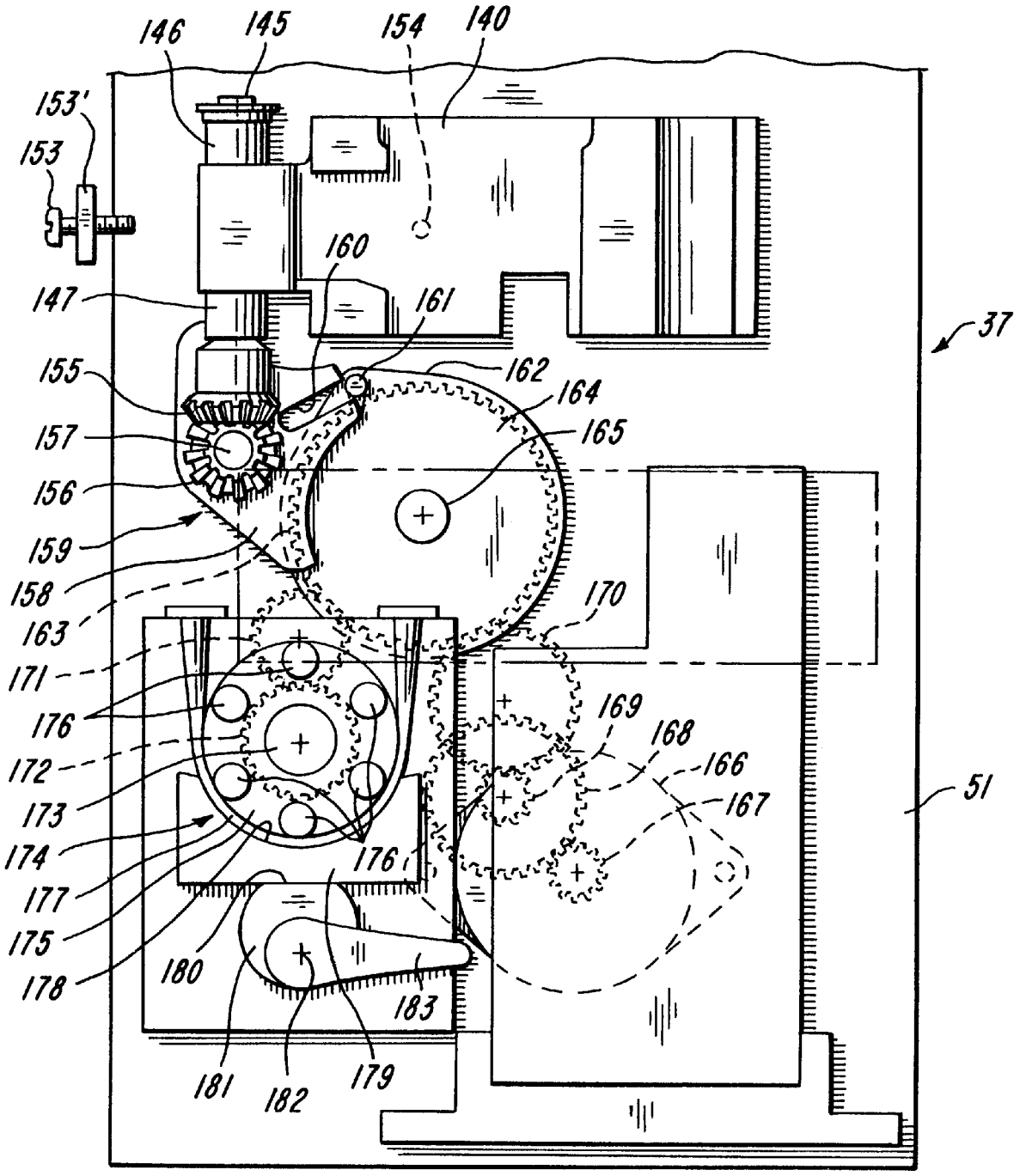
FIG. 9 is a front view of one of the print modules.

With reference to FIGS. 6 and 9, there is shown one of the print modules, e.g. the module 37. The module 37 includes the print head 29 (not shown in FIG. 9) which is mounted on a print head support 140. The support 140 is a plate having a contoured surface also shown in FIGS. 10 and 11. Print head units 141 and 142 having nozzles (not shown) at their lower surfaces 143 and 144. The support 140 is shown to be movably mounted, and preferably pivotally mounted on a shaft 145. The shaft 145 is supported by spaced fixed members 146 and 147. A bracket 148 is secured to arm 149 of the support 140. A cap screw 150 is secured to the member 146. A tension spring 151 is connected to the bracket 148 and to the cap screw 150. In the printing position shown, the spring 151 is behind axis 152 of the shaft 145 and urges the support 140 overcenter in a clockwise direction (FIG. 6) against an adjustable stop screw 153 (FIGS. 1 and 9) in a fixed plate 153'. The adjusted position of the stop screw 153 precisely determines the printing position. When the support 190 is overcenter in the other direction, as when the support 140 is at or near the home position, the position of the support is determined by an adjustable stop screw 154.

A bevel gear 155 secured to the vertical shaft 145 meshes with a bevel gear 156 secured to a horizontal shaft 157. Also secured to the shaft 157 is a section 158 of a Geneva wheel of a Geneva mechanism 159. The Geneva section 158 has a slot 160 for receiving a pin 161 on a plate 162. The plate 162, a gear 163 and a gear 164 are secured to a shaft 165. The gear 163 is behind the gear 164 and the plate 162 is behind the gear 163. The teeth on the gear 163 extend for 360 degrees, however, the gear 164 is considered to be a mutilated gear in that its teeth extend for only a portion of a circle as best shown in FIG. 5. The gear 163 is not shown in FIG. 5 for clarity.

A stepping motor 166 secured to the plate 51 drives a gear 167. A driven gear 168 meshes with the gear 167 (which is not a part of the module 37) when the module 37 is in place as shown in FIG. 9. As the module 37 is moved into its operating or printing portion of FIG. 7, the gear 168 goes into mesh with the drive gear 67 and when the module 37 is moved away from its operating position the gear 168 moves out of mesh with the drive gear 167. The gear 168 is fixed secured to a pinion 169 which in turn meshes with a gear 170. The gear 170 meshes with the gear 163.

A gear 171 can mesh with the mutilated gear 164 when the mutilated gear 164 is in the right position. The gear 171 meshes with a gear 172 which drives a one-way clutch 173. The one-way clutch 173 drives a peristaltic pump generally indicated at 174. The pump 174 has a rotor 175 which mounts a plurality, e.g. six, rollers 176. As the rotor 175 rotates (clockwise in FIG. 9), the rollers 176 compress a flexible tube 177. The tube 177 is part of the ink delivering system 190 shown diagrammatically in FIG. 12. The tube 177 is locally compressed by the rollers 176 against an arcuate surface 178 of an anvil or block 179. The block 179 is held in the operating position shown in FIG. 9 by a flat 180 on a cam 181. The cam 181 has an eccentric axis 182. A crank or handle 183 is secured to the cam 181 which enables the cam to be rotated to lower the block 179 for servicing the tube 177 or after components.

The motor 166 can be controlled to rotate the gear 167 in either direction. By rotating the gear 167 in one direction, the plate 162 is rotated counterclockwise (FIG. 9) to cause the pin 161 to enter the slot 160 and move the print head from the stored or non-operating position (FIG. 9) to the printing position (FIG. 6). There is enough clearance between the Geneva section 158 and the wheel 162 to provide a certain amount of play or lost motion in the shaft 145 to enable the stop screws 153 and 154 to determine the respective printing and stored positions of the print head 29. As the pin 161 enters the slot 160 as shown in FIG. 9 upon counterclockwise rotation of the plate 162, the Geneva plate 158 is rotated clockwise by 90 degrees. To return the print head 29 from its printing position to its stored position, the gear 167 is rotated in the opposite direction to bring the Geneva section from the FIG. 5 position to the FIG. 9 position.

To operate the pump 164, the gear must be rotated to bring the mutilated gear 164 into mesh with the gear 171. Upon rotation of the gear 164 in one direction the rotor 175 rotates clockwise (FIG. 9) to draw ink from the cartridge 43 and deliver it to the print heads 29 and 30. When the gear 164 rotates in the opposite direction, the one-way clutch 173 does not transmit any motion to the rotor 175. To advance the rotor 175 again, the gear 167 must be driven in the direction that causes the rotor 175 to be driven clockwise (FIG. 9). The motor 167 is a stepping motor that can be driven in precise increments in either direction alternately. Because the gear 164 is incomplete or mutilated, the pump 174 is never operated when the print head 29 is in the printing position (FIG. 6). In fact, the pump 174 is only operated when the print head 29 is in the stored position (FIG. 9).

Figure 12:
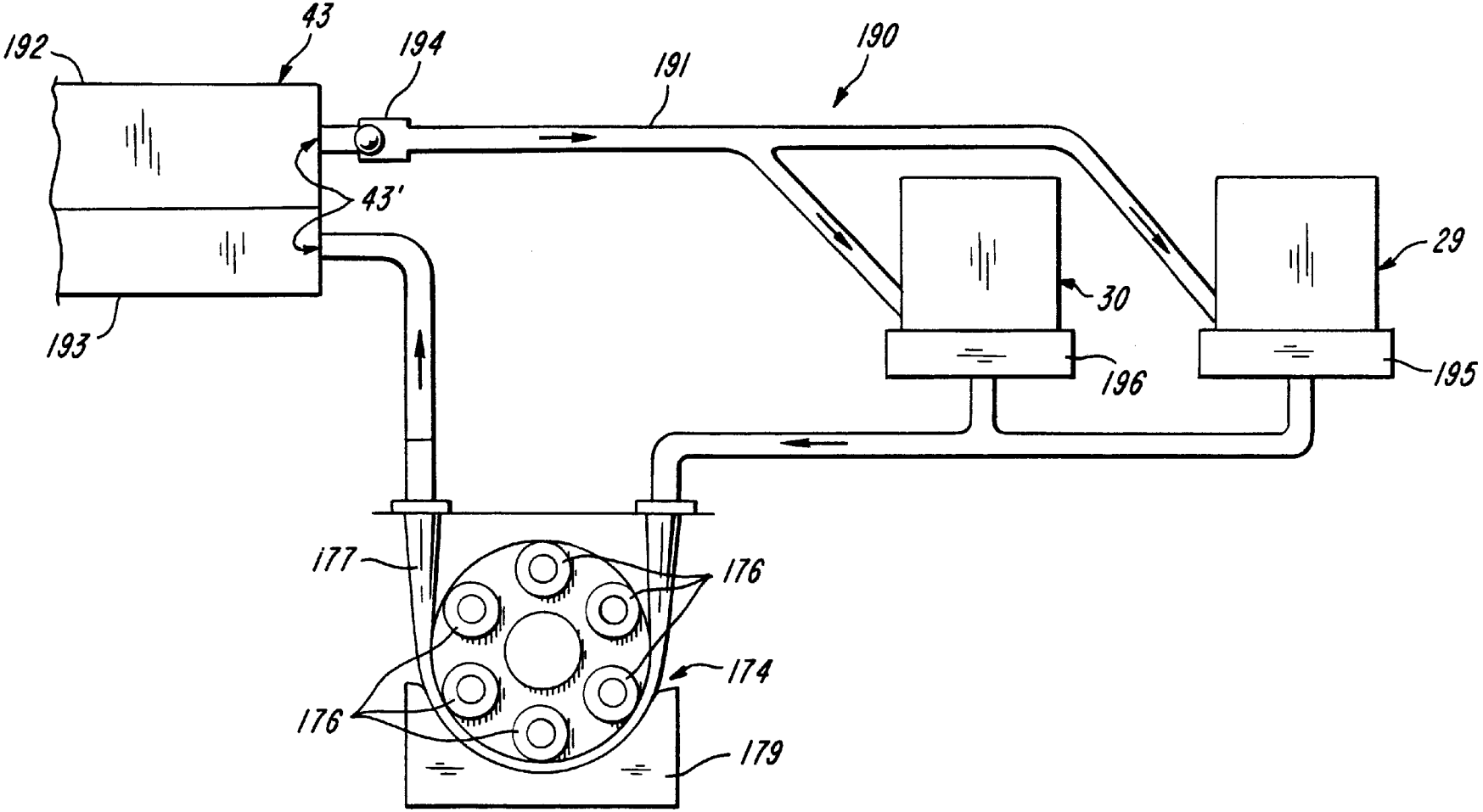
FIG. 12 is a diagrammatic view of the ink delivery system.

FIG. 12 shows the entire ink delivery system generally indicated at 190. The entire system 190 is part of the removable print module 29. The system 190 includes tubing 191 of which the tube 177 forms a part. The cartridge 43 includes a supply container 192 and waste container 193. A check valve 194 prevents ink in the tubing 191 from flowing back into the supply container 194. Ink is pumped to both print heads 29 and 30. Collectors 195 and 196 collect excess ink from the print heads 139 and 130 in their stored or non-operating positions. The pump 174 draws ink from the supply container 192 to the print heads 29 and 30 and removes excess or waste-ink from the collectors 195 and 196. The excess ink is passed to the waste container 193 by the pump 174.

Figure 10:
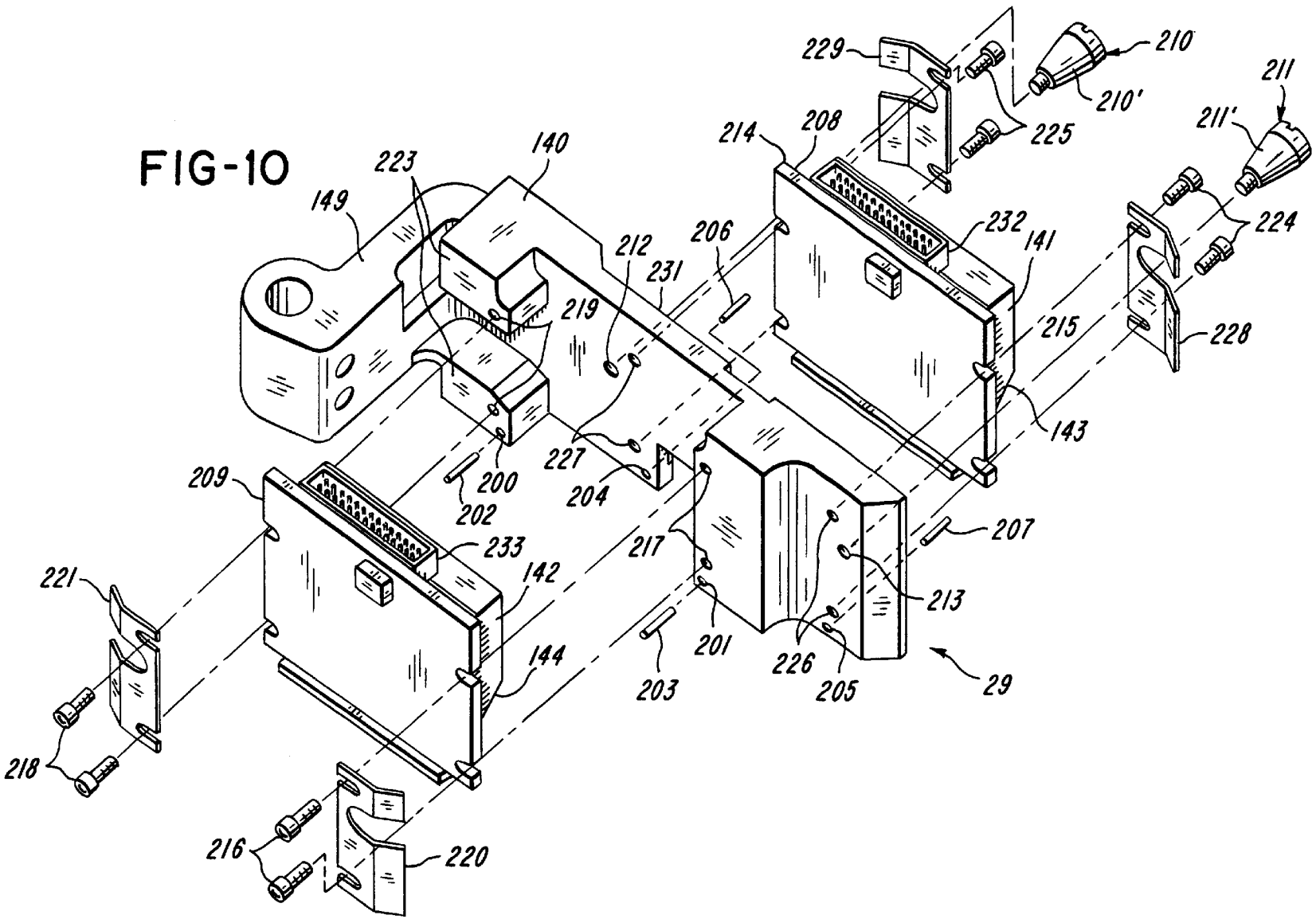
FIG. 10 is a perspective exploded view of a print head and support structure.
Figure 11:
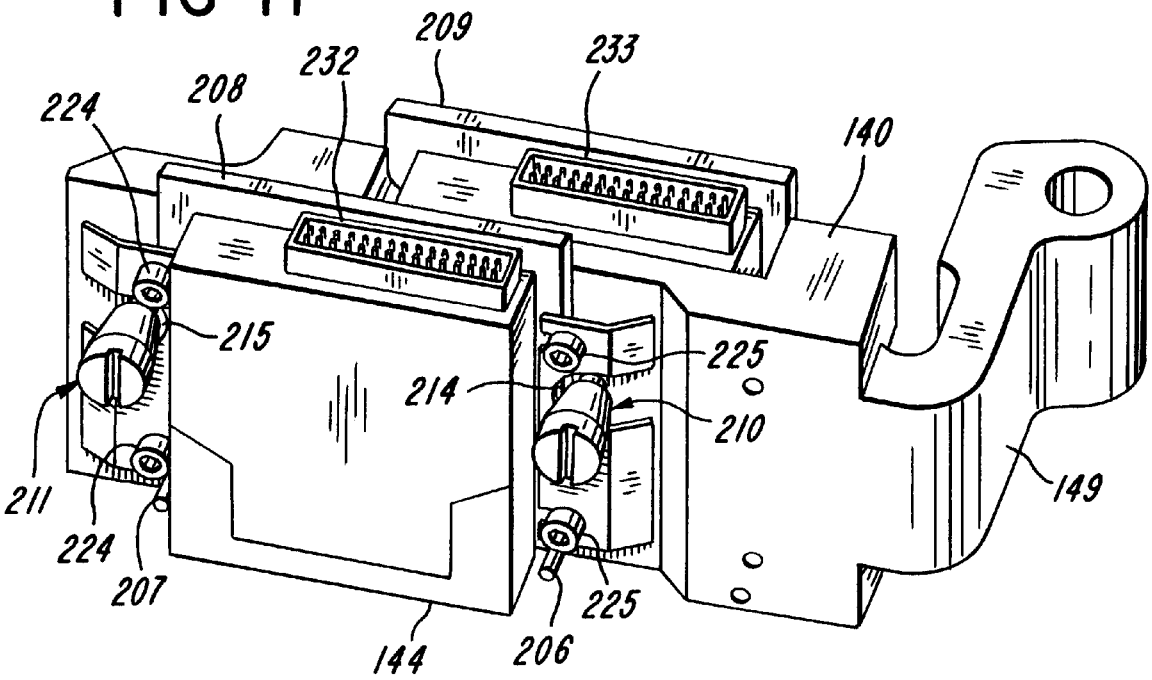
FIG. 11 is an assembled perspective view of the print head and support structure.

With reference to FIGS. 10 and 11, the support 140 is shown to have a pair of holes 200 and 201 for mounting locating pins 202 and 203. Similarly, holes 204 and 205 mount locating pins 206 and 207. The locating pins 202, 203 and 206 and 207 locate respective print heads 142 and 141 vertically. The print heads 141 and 142 are mounted on respective plates, 208 and 209 which bear against the locating pins 206 and 207, and 202 and 203. A pair of cone screws or cams 210 and 211 enable two-direction lateral or horizontal adjustment of the print head unit 141. The cone screws 210 and 211 are threadably received in holes 212 and 213. Cam surfaces 210' and 211 ' act against respective edges 214 and 215 of the plate 208. By threading the cone screw 218 further into the hole 212, the plate 208 and the print head unit 141 which it mounts are moved to the right (FIG. 10); this assumes that the cone screw 211 is threaded out far enough to allow the plate 208 to move to the right (FIG. 10). To move the plate 208 to the left (FIG. 10), the cone screw 210 is loosened and the cone screw 211 is threaded into the hole 213. In this way the horizontal or lateral position of the print head unit 141 can be precisely positioned relative to the print head unit 142. The use of the two print head units 141 and 142 permits double wide printing to occur in the label web W, because one print head unit prints where the other cone leaves off. The same result could be achieved by using a print head unit that is twice as wide laterally as one of the print head units 141 or 142.

The print head 142 unit is not laterally adjustable. However, it is clamped in place by screws 216 received in holes 217 and by screws 218 received in holes 219 cooperating with respective clamps 220 and 221. The clamps 220 and 221 bear against surfaces 222 and 223. Likewise screws 224 and 225 received in holes 226 and 227 urge clamps 228 and 229 against surfaces 230 and 231. Connectors 232 and 233 for the print head units 141 and 142 are connected to the printed circuit board 44 (FIG. 5) via ribbon connectors 234 and 235 (FIG. 6).

Although details of the print module 29 have been shown and described, the print module 30 is identical thereto.

The print head units 141 and 142 are identical. By way of example, not limitation, a print head unit useful in carrying out the invention is Nu-Kote model 128B with 128 nozzles.

With reference to the embodiment of FIGS. 13 through 20, the same reference characters are used as in the embodiment of FIGS. 1 through 12 for components having the same construction, function and relative location. The roll R comprised of the label web W is suitably rotatably supported. The web W passes from the roll R to an unwind mechanism U. The unwind mechanism U helps to prevent the web W from stretching excessively as the web is advanced by cooperating rolls 259 and 260. Absent the unwind mechanism U, the inertia of the roll R can cause the web W to stretch excessively which can degrade print quality. The web W first passes partially around a freely rotatable roll 250 and from there more than 180° about a feed roll 251. The web W passes between the nip of the feed roll 251 and a freely rotatable back-up roll 252. From there the web W is shown to loop as indicated at 253 and then passes between a stationary curved surface 254 and a curved surface 255 on an arm 256 which is pivotally mounted on a pivot 257. From there the web W passes upwardly and partially around a guide 24 and then partially around a guide 25. From there the web W passes downwardly and partially around a guide 27 and thereafter partially around the guide 28. From there the web W passes over and in contact with a guide 39 and then passes under and in contact with a roll 258 and into the nip of feed roll 259 and back-up roll 260.

From there the web can be cut into labels, rewound, or further treated. As the web W passes between the guides 27 and 28, the underside of the web W can be printed by the print head 30. The print head 29 located downstream of the roll 39 can print on the top side of the web.

Figure 13:
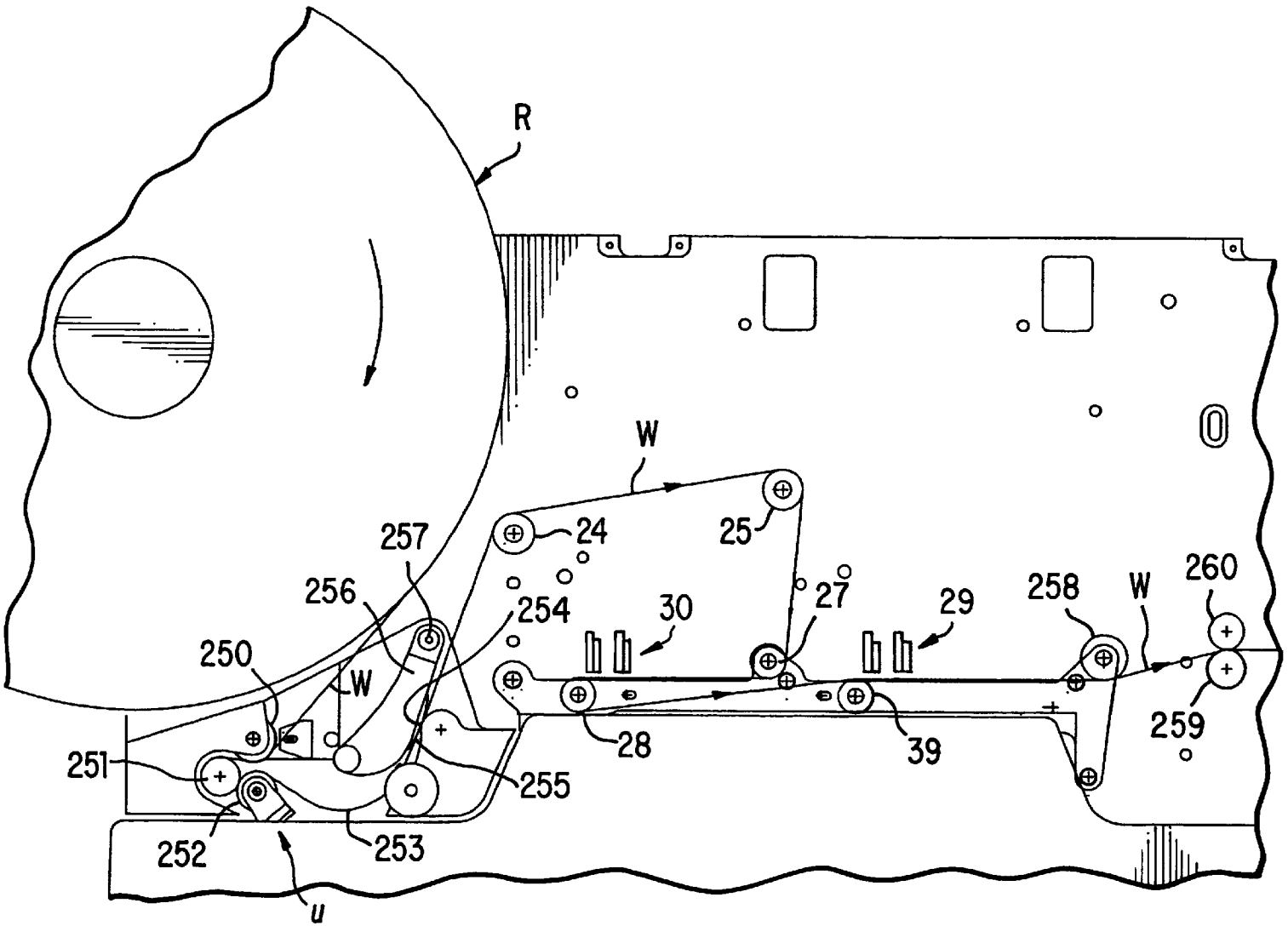
FIG. 13 is a side elevational view of the ink jet printer showing an alternative arrangement for threading a web wherein both sides of the web can be printed.
Figure 14:
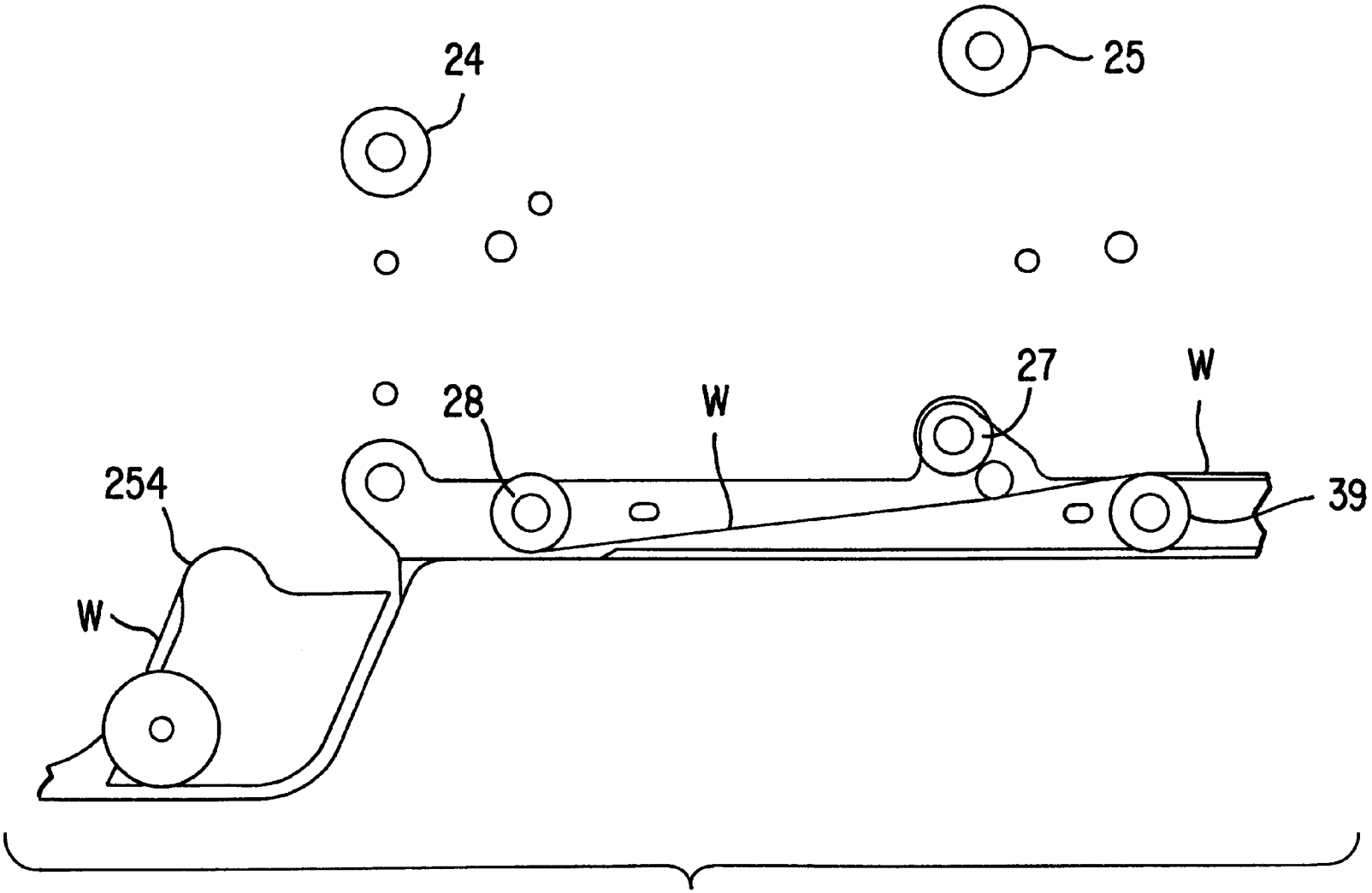
FIG. 14 is a fragmentary side elevational view showing an alternative arrangement for threading a web wherein only the top side of the web is to be printed.

FIG. 14 shows an alternative path for the web W from the path shown in FIG. 13. After the web W passes around the curved surface 254 the web W passes under and partially around the roll 28 and over and partially around the roll 39. In other respects the web path is the same as illustrated in FIG. 13. Each of the guides 24, 25, 27, 28 and 29 preferably comprises a roll rotatable about a fixed axis. In particular, the rolls 24 and 25 can be crown rolls. It is to be noted that even though the web W passes under the guide 27, the guide 28 prevents the web W from contacting the guide 27. Except for rotation of the rolls which comprise the guides 24, 25, 27, 28 and 39 being rotatable about fixed axes, these guides are stationary.

Figure 15:
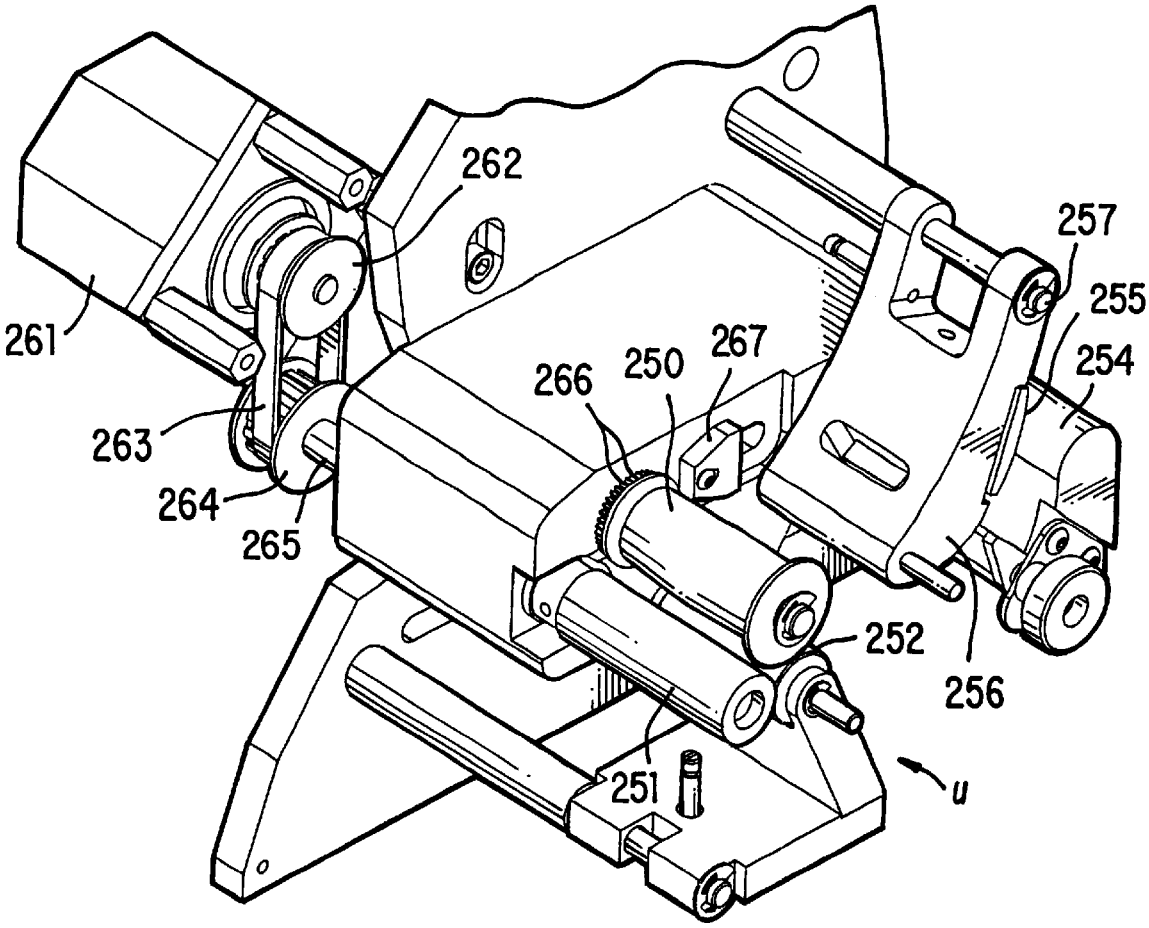
FIG. 15 is a perspective view showing an arrangement for unwinding the web from a supply roll and for maintaining tension in the web.
Figure 16:
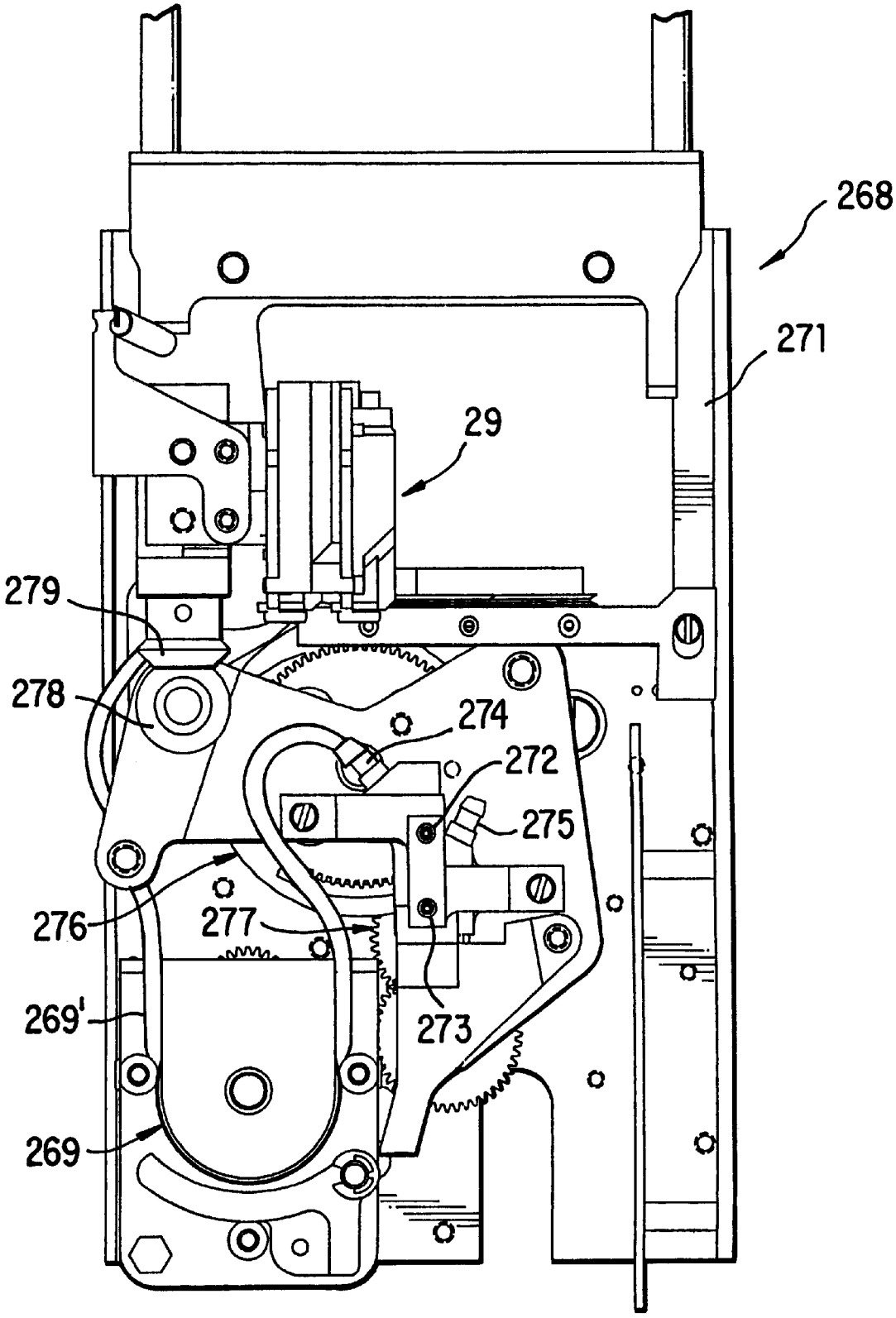
FIG. 16 is a side elevational view of an alternative embodiment of one print head module for the printer.
Figure 17:
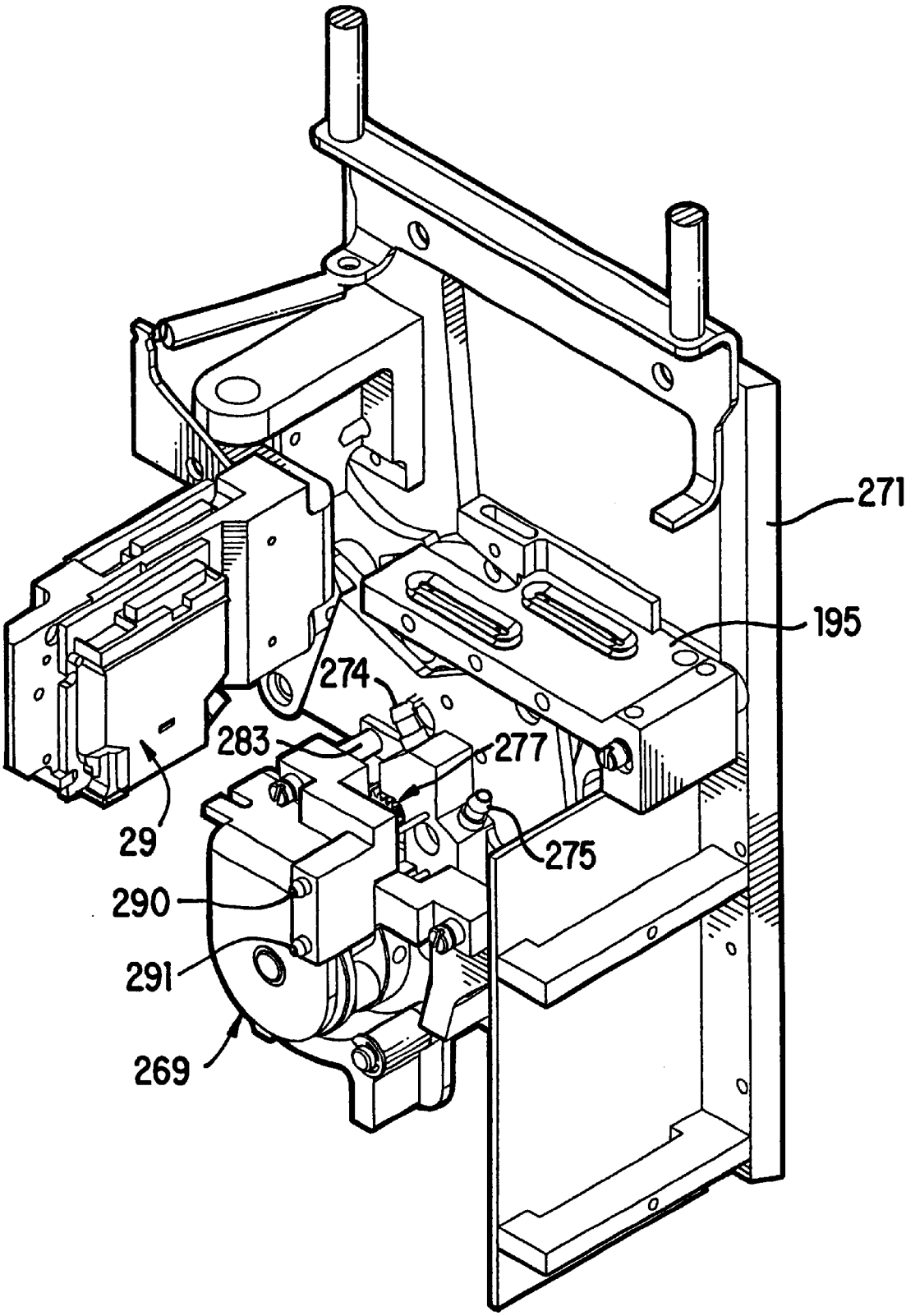
FIG. 17 is a perspective view of the print head module shown in FIG. 16.

With reference to FIG. 15, there is shown a stepping motor 261 for driving a toothed pulley wheel 262. A toothed belt 263 engaged with the pulley wheel 262 also engages a toothed pulley wheel 264. The pulley wheel 264 is secured to a drive shaft 265 which mounts the drive roll 251. The roll 250 has equally spaced teeth 266 sensed by a sensor 267 when the roll 250 is rotated by the advancing web W. The arm 256 pivots clockwise (FIGS. 13 and 15) in response to tautness in the web W. The condition wherein the web W is taut is sensed by a sensor (not shown) responsive to the position of the arm 256 which in turn increases the speed of the motor 261 and the rotational speed of the roll 251. The purpose of the sensor 267 is to detect the rotation of the roll 250. The absence of rotation of the roll 250 indicates that the web W is no longer available from the roll R or that the roll R is no longer free to rotate. With reference to FIGS. 16 and 17, there is shown a print head module generally indicated at 268. There are two identical such modules 268 which are functionally and structurally similar to identical print head modules 37 and 38. Two such modules 268 are used in the illustrated printer. A peristaltic pump 269 (similar to pump 174) pumps ink from a source of supply (such as the supply container 192 of the cartridge 43) through tubing (such as the tubing 191) to the print head 29. Waste ink is returned through the tubing 191 to a waste container (such as the waste container 193).

The module 268 has a frame 271 to which forwardly projecting needles 272 and 273 are rigidly mounted. The needles 272 and 273 (like the needles 43') have pointed ends. The pointed needles 272 and 273 communicate respectively with the ink in the ink container 192 and with the waste container 193 by piercing respective diaphragms. With reference to FIG. 16, the needle 273 is connected through a fitting 275 which in turn is connected to the ink container via tubing 191. A fitting 274 connected to the needle 272 is connected via the tubing 269' to the pump 269.

A stepping motor (not shown in FIG. 16 but corresponding to the motor 166) drives the pump 269 and a Geneva mechanism 276 through gearing 277. A bevel gear 278 driven by the Geneva mechanism 276 drives a bevel gear 279 to swing the print head between its operating position as shown in FIGS. 16 and 17 and its stored position, as in the embodiment of FIGS. 1 through 12.

Figure 18:
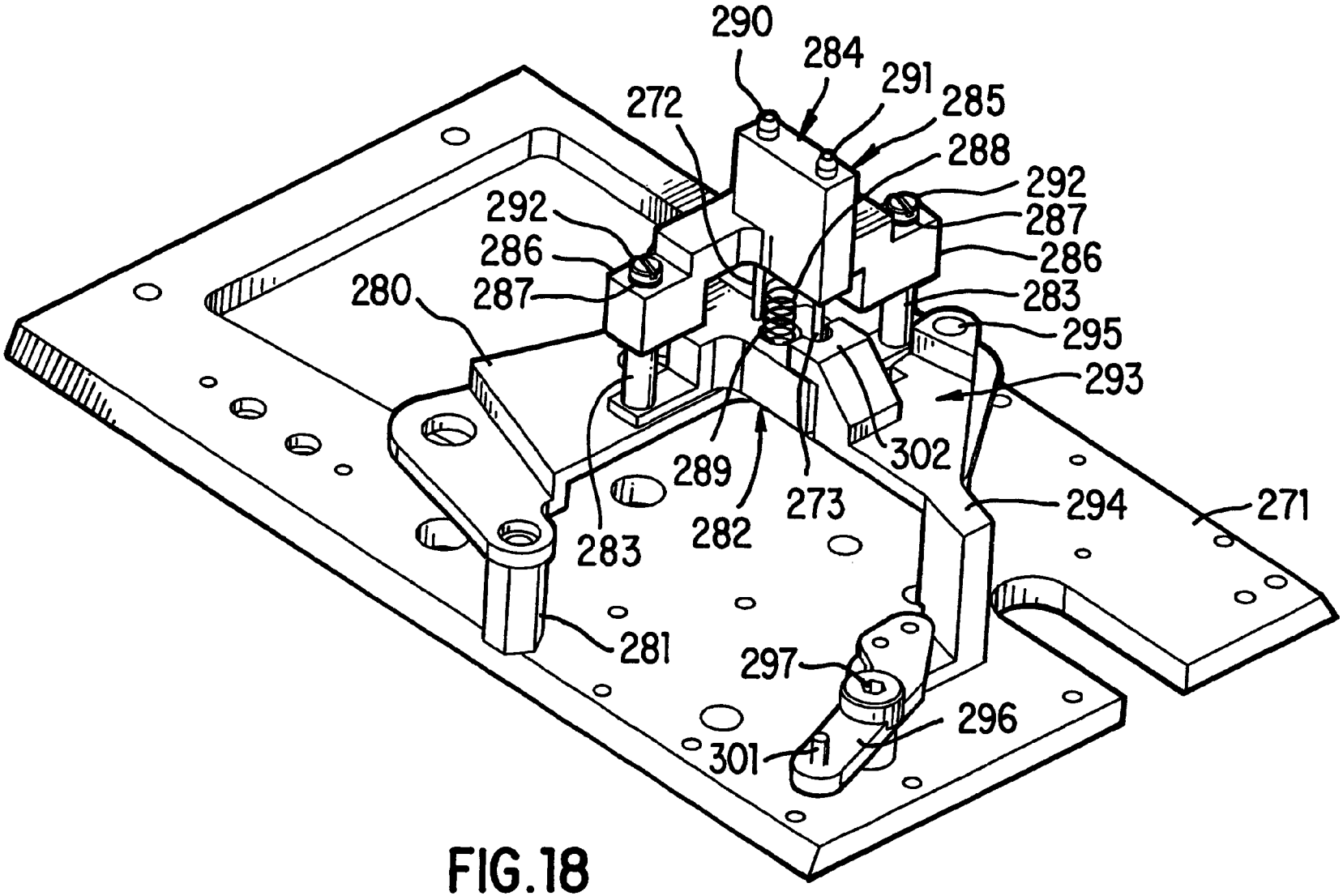
FIG. 18 is a fragmentary perspective view showing the module frame, the needles, the guard for the needles, and the interposer in its interposing or blocking position.
Figure 19:
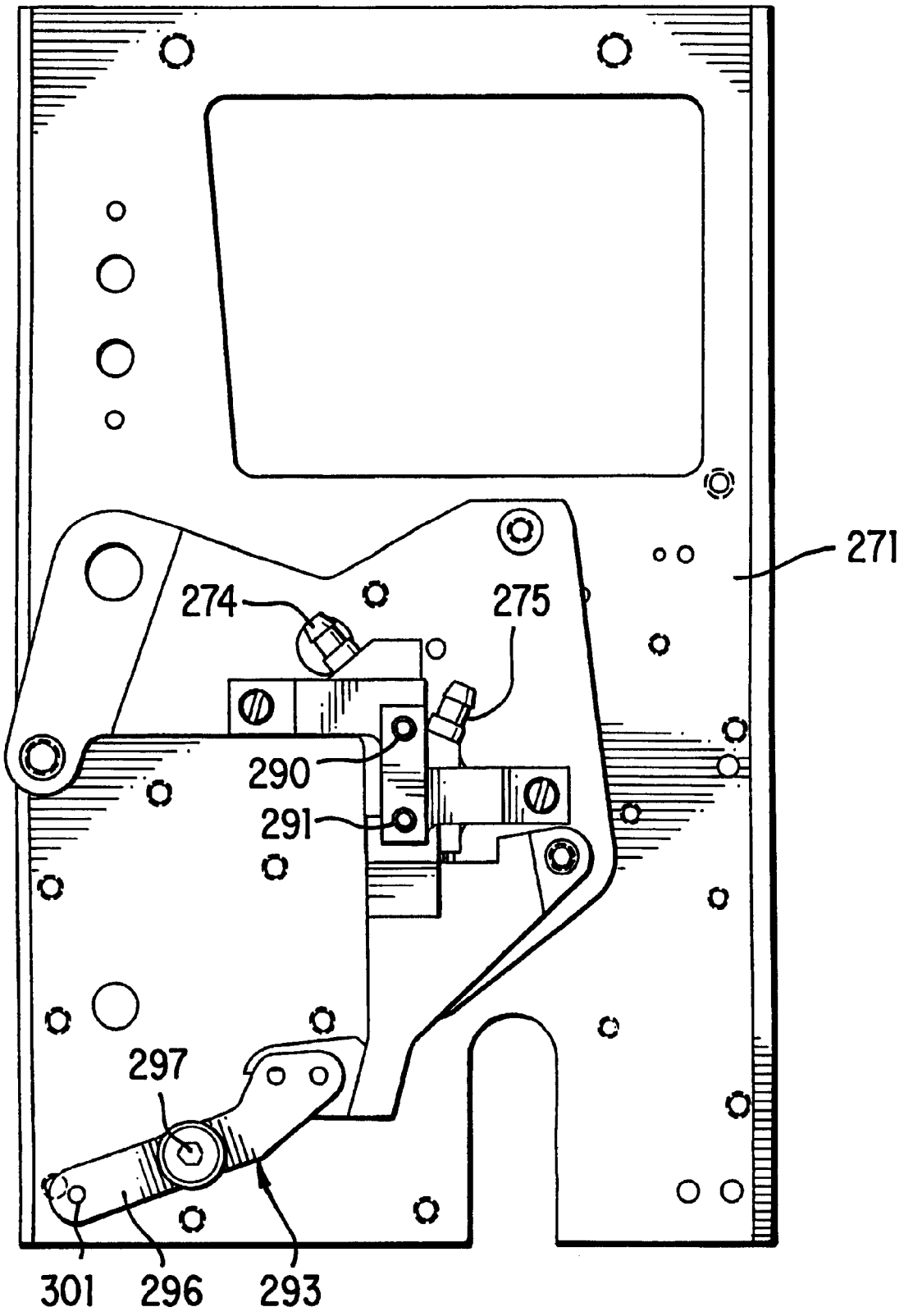
FIG. 19 is a fragmentary elevational view of the fragment of the module shown in FIG. 18.
Figure 20:
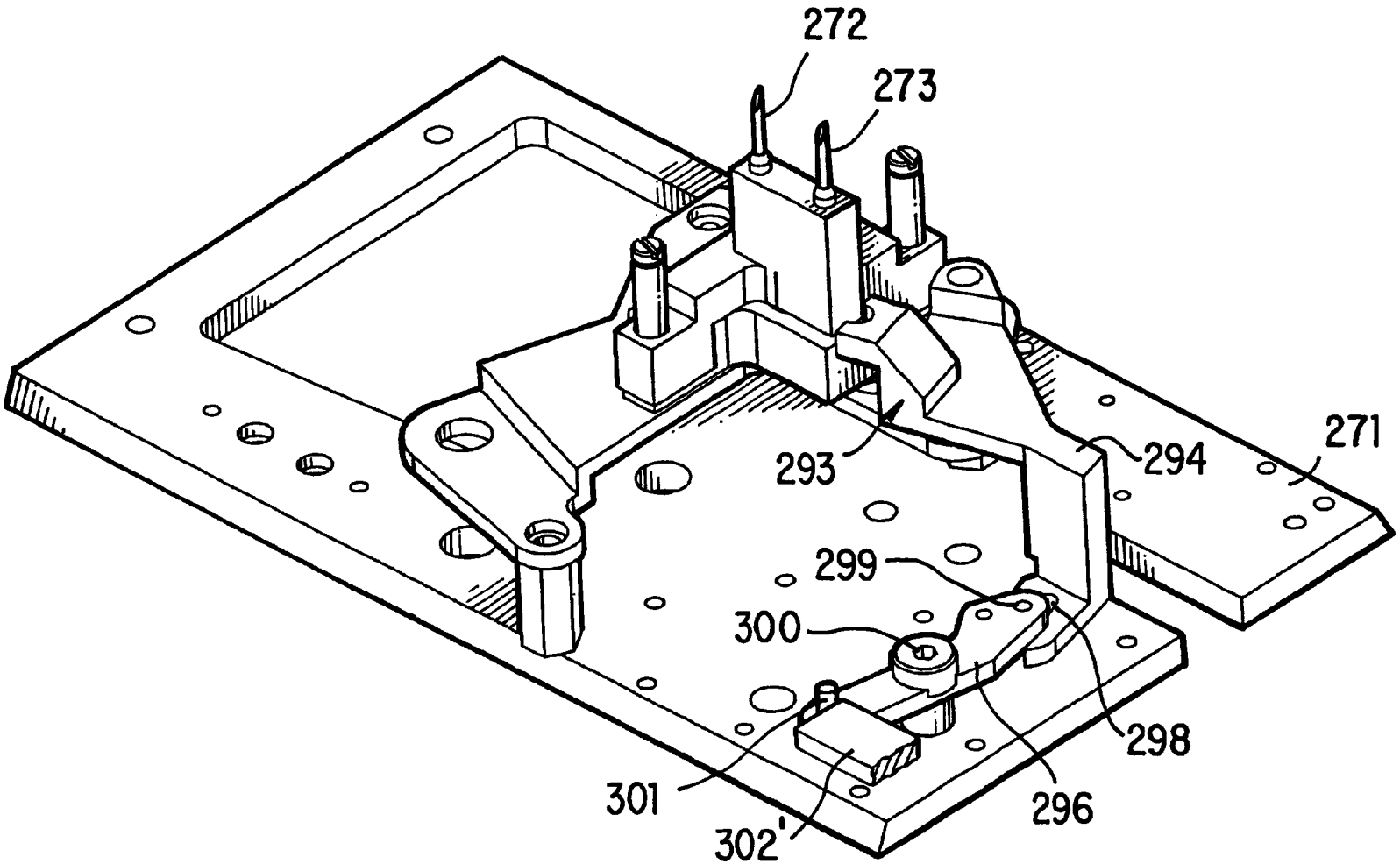
FIG. 20 is a fragmentary perspective view similar to FIG. 18, but showing the interposer in its ineffective position.

With reference to FIGS. 18 through 20, there is shown the frame 271 and a plate 280 connected by stand-offs 281, only one of which is shown. A needle block or holder 282 which mounts the needles 272 and 273 is secured to the plate 280. A pair of posts 283 project from the needle block 282. A guard 284 includes a needle guarding portion 285 and a pair of arms 286. The arms 286 have through holes 287 for receiving the posts 283. The guard 284 is slidable on the posts 283. A compression spring 288 nested in a pocket 289 in the needle block 282 urges the guard 284 away from the needle block 282. The needle guarding portion 285 has a pair of respective round through holes 290 and 291 aligned with the needles 272 and 273. In the position shown in FIG. 18 the pointed ends of the needles 272 and 273 are completely within the holes 290 and 291. Accordingly, the guard 284 is received about the ends of the needles 272 and 273. Thus, when the module 268 is out of the printer, the pointed needles 272 and 273 cannot be damaged and the user cannot contact the printed ends of the needles 272 and 273. The guard 285 is incapable of separating from the pins 283 except by removal of screws 292 the heads of which are larger than the holes 287 and provide stops. An interposer generally indicated at 293 is shown to comprise an arm 294 pivotally mounted on a pin 295 and an arm or lever 296 pivotally mounted on a pivot 297. The arm 294 has an elongate slot 298 for receiving a pin 299 carried by arm 296. The lever 296 is pivotally mounted on a pivot 300. The pivot 300 mounted on the frame 271 is located between the pin 299 and a pin 301 on the lever 296. In the guarding position shown in FIGS. 18 and 19, the interposer 293 is shown in its effective or interposing position, whereas in FIG. 20 the interposer 293 is shown in its ineffective position. With the interposer 293 in the effective or guarding position, interposer element 302 is positioned between the guard 285 and the needle block 282. Any attempt to move the guard sufficiently to cause the pointed ends of the needles 272 and 273 to project through the holes 290 and 291 is prevented when the needle guarding portion 284 abuts the interposer element 302. When the needle guarding portion 284 contacts and is prevented from further movement relative to the needles 272 and 273 the pointed ends of the needles 272 and 273 are still completely within the holes 290 and 291.

When the module 268 is slid vertically into its operating position in the printer, a position like that shown in FIGS. 5, 6 and 17, the pin 301 contacts a vertically extending plate or projection 302' on the printer frame, which causes the lever 296 to pivot clockwise (FIG. 20), which in turn causes the link 294 to pivot counterclockwise, thereby enabling the guard 285 to be shifted against the action of the spring 288 to expose the pointed ends of the needles 272 and 273 as the needles 272 and 273 penetrate the respective ink and waste containers 192 and 193. When the cartridge, e.g. the cartridge 38 is withdrawn, the spring 288 is again effective to return the guard to its position as shown in FIG. 18. In this position the pointed ends of the needles 272 and 273 are guarded, although depression of the guarding portion 285 and compression of the spring 288, such as by reinsertion of a cartridge 43, will enable the needles 272 and 273 to again penetrate the cartridge 43.

What is claimed is:

1. Apparatus for printing on a label web, comprising: a printer including a printer frame and a print head module removable mounted to the printer frame, the module including an ink jet print head, at least one needle having an end for penetrating a source of ink, tubing connecting the needle and the print head, a movable guard for the end of the needle, the guard being operative to guard the end of the needle whenever the module is removed from the printer frame, the printer frame having a projection, the module further including an interposer for blocking movement of the guard, the interposer being operative in response to engagement with the projection for moving the interposer to unblock movement of the guard to enable the guard to move to expose the end of the needle whenever the module is mounted to the printer frame, and wherein the guard is movable to cause the end of the needle to penetrate the source of ink when the source of ink engages the guard.

2. Apparatus as defined in claim 1, including a spring, wherein the guard is movable by the spring to a position in guarding relation to the end of the needle, wherein in one position of the interposer movement of the guard to expose the end of the needle is prevented, and wherein in another position of the interposer movement of the guard against the action of the spring is enabled to allow the needle to penetrate the source of ink.

3. Apparatus as defined in claim 1, including means for unwinding a label web from a supply roll, a second print head module, means for selectively threading the web to enable the underside of the web to be printed by the first-mentioned print head module and the top side to be printed by the second print head module or to enable only the top side of the web to be printed by the second print head module, means for drawing the web past the print head modules, and wherein the second print head module is removable from the printer.

4. Apparatus as defined in claim 1, wherein the interposer is disposed between the guard and the printer frame when the module is removed from the printer and the interposer is out of the way of the guard when the module has been mounted in the printer.

5. Apparatus as defined in claim 1, and at least one spring for maintaining the enabled guard in its guarding position until the guard is moved relative to the needle by the source of ink and the projection has been engaged by the module.

6. Apparatus for printing on a label web, comprising: a printer including a printer frame and a print head module removably mounted on the printer frame, the module including an ink jet print head, at least one needle having an end for penetrating a source of ink, tubing connecting the needle and the print head, a guard for the end of the needle, the guard being movable between a first position in guarding relation to the needle and a second position wherein the needle is exposed for communication with the source of ink, a projection on the printer frame, an interposer for selectively blocking movement of the guard from the first position to the second position, wherein the interposer is moved in response to contact with the projection from a position in blocking relation to the guard to a position out of blocking relation to the guard when the module is positioned onto the printer frame, and at least one spring for urging the guard to the first position until the source of ink is moved against the guard to move the guard to the second position in which the needle penetrates the source of ink.

7. Method of using an ink jet printer, comprising: providing an ink jet printer having a printer frame and a module insertable onto and removable from the printer frame, the module including an ink jet print head, a needle with a pointed end and tubing connecting the print head to the needle, guarding the pointed end of the needle using a guard until a source of ink moves the guard out of the way, and blocking the guard from moving out of the way whenever the module is out of the printer frame.

8. Apparatus for printing on label webs, comprising: an ink jet printer having a printer frame and a module insertable onto and removable from the printer frame, the module including an ink jet print head, a needle with a pointed end, tubing connecting the print head and the needle, means including a guard for guarding the pointed end of the needle until a source of ink moves the guard out of the way to enable the needle to penetrate the source of ink, and means for blocking the guard from moving out of the way whenever the module is out of the printer frame.

9. Apparatus as defined in claim 8, when the printer frame includes a projection, wherein blocking means includes an interposer responsive to engagement with the projection for moving the interposer out of the way of the guard.

* * * * *

UNITED STATES PATENT AND TRADEMARK OFFICE

CERTIFICATE OF CORRECTION

PATENT NO. : 6,336,718
DATED : January 8, 2002
INVENTOR(S) : Raymond A. Blanchard, Jr., Charles M. Curley and David M. Stewart It is certified that error appears in the above-identified patent and that said Letters Patent is hereby corrected as shown below:

Column 10,
Line 58, "removable" should be "removably".

Signed and Sealed this

Twenty-first Day of May, 2002

*Attest:*

*Attesting Officer*

JAMES E. ROGAN
*Director of the United States Patent and Trademark Office*